United States Patent [19]

Brocklehurst

[11] Patent Number: 4,462,322

[45] Date of Patent: Jul. 31, 1984

[54] SHEET PRODUCTION SYSTEM WITH HEM EXPANDER

[75] Inventor: Charles E. Brocklehurst, Fountain Inn, S.C.

[73] Assignee: Opelika Manufacturing Corporation, Chicago, Ill.

[21] Appl. No.: 406,274

[22] Filed: Aug. 8, 1982

Related U.S. Application Data

[60] Division of Ser. No. 153,084, May 27, 1980, Pat. No. 4,353,316, which is a continuation-in-part of Ser. No. 956,792, Nov. 1, 1978, Pat. No. 4,269,130.

[51] Int. Cl.[3] ..... D05B 35/02

[52] U.S. Cl. ..... 112/141

[58] Field of Search ..... 112/141, 142, 143, 147, 112/DIG. 2, DIG. 3, 10, 11, 121.11, 121.12, 121.15, 121.26, 121.29, 63

[56] References Cited

U.S. PATENT DOCUMENTS

| | | | |
|---|---|---|---|
| 1,469,168 | 9/1923 | Mets | 271/186 X |
| 2,053,257 | 9/1936 | Anderson | 112/2 |
| 2,546,831 | 3/1951 | Newell | 112/2 |
| 2,738,746 | 3/1956 | McIsaac, Jr. et al. | 112/2 X |
| 2,823,788 | 2/1958 | Chase | 271/225 X |
| 2,940,404 | 6/1960 | Damon | 112/10 |
| 2,962,989 | 12/1960 | Golden | 112/10 |
| 3,224,394 | 12/1965 | Debner | 112/10 |
| 3,375,796 | 2/1968 | Greenberg et al. | 112/2 |
| 3,477,397 | 11/1969 | Hawley | 112/304 X |
| 3,489,113 | 1/1970 | Flanagan | 112/2 |
| 3,580,198 | 5/1971 | Teed et al. | 112/121.11 |
| 3,631,826 | 1/1972 | Morgan | 112/DIG. 2 |
| 3,640,235 | 2/1972 | Burton | 112/121.29 |
| 3,772,948 | 11/1973 | Burton | 112/121.29 X |
| 3,773,002 | 11/1973 | Burton | 112/121.29 X |
| 3,865,058 | 2/1975 | Rovin et al. | 112/10 |
| 3,906,878 | 9/1975 | Burton | 112/423 |
| 3,955,515 | 5/1976 | Elsas | 112/262.2 |
| 4,066,025 | 1/1978 | Speer | 112/141 X |
| 4,095,537 | 6/1978 | Silverman et al. | 112/141 X |
| 4,132,184 | 1/1979 | Burton | 112/262 |
| 4,154,180 | 5/1979 | Burton | 112/121.29 X |

FOREIGN PATENT DOCUMENTS

| | | | |
|---|---|---|---|
| 2529103 | 1/1977 | Fed. Rep. of Germany | 271/186 |

*Primary Examiner*—H. Hampton Hunter

*Attorney, Agent, or Firm*—Thomas & Kennedy

[57] ABSTRACT

Sheet material is taken from a supply, moved along its length to a cutting station, the sheet material is cut into segments, and the cut segments are moved parallel to their cut edges, the cut edges are hemmed, and the segments are folded. At the cutting station the leading portion of the sheet material is gripped and pulled from the entrance to the cutting station to the other side thereof, a slack bar is moved downwardly into the segment of sheet material in the cutting station to form slack in the segment, and the segment in the cutting station is clamped against parallel conveyor tapes. A cutting disc is drawn across the sheet material at the entrance to the cutting station, and the parallel conveyor tapes move the sheet parallel to its cut edges to a hemming station where the edges are folded and hemmed. The hems of the side edges are expanded after being mechanically formed and prior to being sewn. The leading and trailing edges of the folded portions of the hems are aligned with the leading and trailing edges of the unfolded portion of the hem as the segment approaches the sewing machine.

9 Claims, 21 Drawing Figures

SHEET PRODUCTION SYSTEM WITH HEM EXPANDER

This application is a division of application Ser. No. 153,084, filed 5/27/80 now U.S. Pat. No. 4,353,316, dated Oct 12, 1982 which is a continuation-in-part of U.S. Patent application Ser. No. 956,792,filed Nov. 1, 1978 now U.S. Pat. No. 4,269,130, dated May 26, 1981.

TECHNICAL FIELD

This invention relates to the manufacture of bed sheets and other sheet material wherein sheet material is moved from a supply along its length to a cutting station, the sheet material is cut into segments, and the cut edges of the segments are hemmed as the segments are moved along a path parallel to their cut edges.

BACKGROUND

In the production of sheet material, such as bed sheets, curtains, bed spreads, etc., the goods usually are cut from a supply of sheet material and the cut edges are hemmed. In some situations the side edges of the cut segments of sheet material do not need to be hemmed since the side edges comprise a selvage of the sheet material. Thus, only the cut edges need to be folded and sewn into a hem.

Various automatic machines have been developed and used for cutting and hemming sheet material. For example, U.S. Pat. Nos. 3,580,198, 3,640,235, 3,772,948, 3,906,878 and 3,955,515 all illustrate systems which appear to be capable of automatically cutting segments from sheet material and hemming the cut edges of the segments. However, it is understood that the prior art devices have experienced some difficulty in controlling the cut edges of the segments of sheet material as the cut edges are being moved to and through a hemmer. This difficulty is increased when a large hem is to be formed at the cut edge of the segment of sheet material. For example, the large hem at the head of a bed sheet usually is visible when in use by the purchaser, and it is desirable to have this hem formed with a constant width, so that it is uniform and attractive to the purchaser. However, when the hem at the head of a bed sheet is formed with automatic hem forming equipment, it is difficult to control the wide expanse of folded material so as to accurately and rapidly form the hem.

SUMMARY OF THE INVENTION

Briefly described, the present invention comprises a sheet production system with a hem expansion attachment, wherein sheet material is moved from a supply along its length toward a cutting station, the sheet material is cut into segments at the cutting station, and the cut segments are moved parallel to their cut edges and the cut edges are folded. The fold at one end of the cut segment is expanded to a large size, and the enlarged fold is sewn to the body portion of the cut segment.

A gripper moves across the cutting station to the entrance of the cutting station to grip the previously cut leading edge of the sheet material and then moves back across to the far side of the cutting station, pulling the sheet material over a pair of a parallel conveyor tapes into the cutting station. A slack bar moves down into the segment of sheet material between the parallel conveyor tapes at the cutting station, causing slack to be formed in the segment, and a clamp at the entrance of the cutting station grips and holds the segment in position while conveyor clamps move down toward the conveyor tapes to clamp the segment of sheet material against the conveyor tapes. A disc cutter is then drawn across the sheet material at the entrance of the cutting station, to cut the segment away from the supply of sheet material. The gripper then releases the cut segment and the conveyor tapes move the cut segment in a direction parallel to its cut edges at a high velocity on into the hem folding and expansion station.

The cut edges of the segment are progressively folded as they move into the folding and expansion station, and after the cut edges have been folded, one folded edge portion of the cut segment is expanded to the desired width for the hem. The segment of sheet material is them moved at a slower speed on through a sewing station where the folded edge portions are sewn to the body of the sheet material, thus forming the hems at the head and foot of the bed sheet. If desired, the system can employ hem expanders for both hems.

After hemming, the segment of sheet material, which is now sewn in the form of a final product such as a bed sheet, is folded for shipment and ultimate sale to the customer.

Thus, it is an object of this invention to provide a bed sheet production system with a hem expander attachment, wherein the system functions to cut segments of sheet material from a supply and to form folded and sewn hems at the cut edges of the segment, with one of the hems being of a large size suitable for use as the hem at the head of a bed sheet.

Another object of this invention is to provide a bed sheet production system which rapidly and accurately cuts segments of sheet material from a supply and accurately forms the head and foot hems in the bed sheet.

Another object of this invention is to provide a hem expander attachment for a sheet production system, which accurately forms the large hem in the head of a bed sheet or a large hem in other sheet products.

Another object of this invention is to provide a hem expander attachment for a sheet production system wherein a fold is made in the edge portion of the sheet material, and the fold is subsequently expanded.

Other objects, features and advantages of the present invention will become apparent upon reading the following specification, when taken in conjunction with the accompanying drawings.

DETAILED DESCRIPTION

Figure 1:
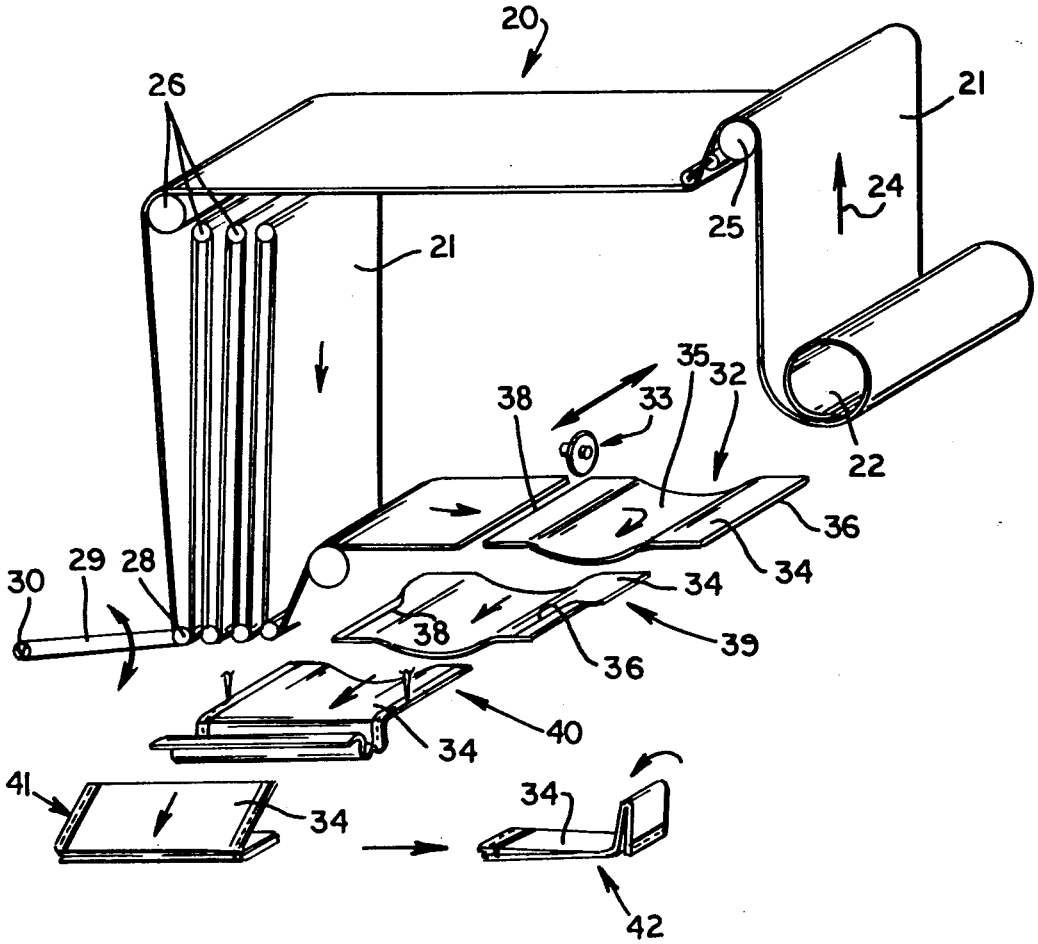
FIG. 1 is a schematic perspective illustration of the sheet production system.

Referring now in more detail to the drawings, wherein like numerals indicate like parts throughout the several views. FIG. 1 schematically illustrates the sheet production system 20, wherein sheet material 21 is taken from a supply such as from reel 22 and fed in an upward direction 24 by a driven feed roller 25 at an inspection station, where a worker inspects the sheet material for flaws, etc. The flaws are marked with a liquid so that the flaws can be detected at the cutting station and the cut segment which includes a flaw can be identified. A particular sheet inspection and marking system suitable for use in this invention is disclosed in U.S. Pat. No. 4,204,012.

The sheet material moves beyond driven roll 25 and then through a serpentine path about upper stationary rolls 26 and lower movable rolls 28. The lower movable rolls are mounted on lever 29, and the lever 29 pivots about fulcrum 30. Thus, the upper and lower rolls 26 and 28 function as an accumulator 31 for the sheet material, to accommodate an increasing or decreasing supply of the sheet material from the inspection station.

The sheet material moves from the accumulator 31 into cutting station 32. A cutter 33 is movable across the sheet material to form cut segments 34. Slack 35 is formed in the sheet material at the cutting station 32 just prior to cutting the sheet material, so that the cut segments 34 have slack therein as they are moved parallel to their cut edges 36 and 38 through hem expansion station 39, and to hemming station 40, and then to pleat folder 41 and spiral folder 42.

The sewing machines and hemming attachments of the type used at hemming station 40 are illustrated in U.S. Pat. No. 3,906,878, and the pleat and spiral folders 41 and 42 are illustrated in U.S. Pat. No. 4,227,084. An improved needle lubrication system of the type disclosed in U.S. Pat. No. 4,369,723 is used with the sewing machines in hemming station 40 in order to increase the speed of operation of the sheet production system. If it is desired to place labels in the finished product, a label dispenser of the type disclosed in U.S. Pat. No. 4,157,692 can be utilized at the hemming station 40.

Figure 2:
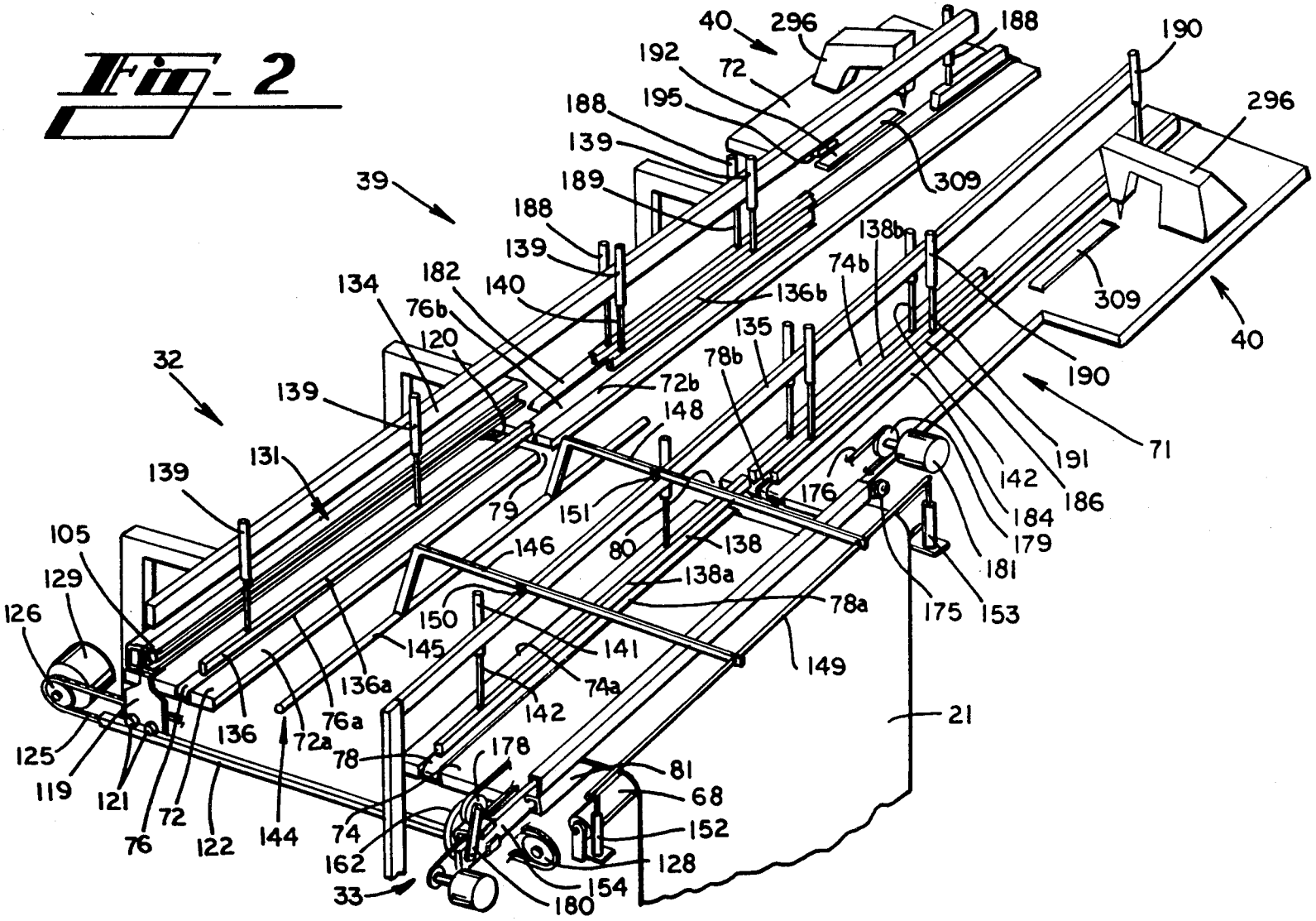
FIG. 2 is a perspective illustration, with parts removed for clarity, of the supply, cutting, expansion and hemming stations of the sheet production system.

As illustrated in FIG. 2, the cutting station 32, the hem expansion station 39 and hemming station 40 are all located in alignment with one another and utilize a single work table assembly 71. Work table assembly 71 is a split work table, with left and right halves 72 and 74 which define an open space 75 therebetween. Additionally, right and left halves 72 and 74 of the work table assembly 71 include cutting station segments **72*a* and 74*a* which are divided from the expansion and hemming segments 72*b* and 74*b*. The work table halves 72 and 74** are movable toward and away from each other to form the cut segments of sheet material in different lengths. This is accomplished with an electric motor and drive system (not illustrated).

A conveyor tape assembly 76 is located in and along work table half 72 while a similar conveyor tape assembly 78 is located in and along work table 74. Since each work table is broken at 79 and 80 to form a passage through the work table assembly, thus forming the work table assembly in sections, the conveyor tape assemblies 76 and 78 are also broken at passageways 79 and 80, with the conveyor tape assemblies being formed in sections **76*a* and 76*b*, and 78*a* and 78*b*. The conveyor tapes 76 and 78 are spaced from each other and are parallel to each other and extend at a right angle with respect to the direction of movement of the sheet material 21 as the sheet material enters the cutting station 32**.

CUTTING STATION

Clamp assembly 81 (FIGS. 2 and 4–6) is located at the entrance 83 of cutting station 32. Clamp assembly 81 includes upper frame 82 and lower frame 84 which are vertically spaced part and which permit the passage therebetween of sheet material 21. A rectilinear clamp bar 85 is mounted on the ends of a plurality of cylinder rods 86, and a plurality of pneumatic cylinders 88 are mounted in the upper frame 82. The clamp bar 85 defines an elongated slot 89 in its bottom surface, and an elongated elastic tube 90 is mounted in the slot. Tube 90 protrudes from the bottom surface of bar 85 toward lower frame 84. Lower frame 84 has an upper horizontal surface 91 over which the sheet material 21 moves, and against which clamp bar 85 and its tube 90 bear. When clamp bar 85 is moved to its down position by its cylinders 88, the clamp bar holds the sheet material 21 against the upper horizontal surface 91 of the lower frame 84, with the flexible tube 90 bearing against the sheet material 21 and against the upper horizontal surface 91.

Lower frame 84 includes platform 91 that extends toward cutting station 32. Movable support means 94 rests on platform 92 and comprises a rectilinear beam of inverted U-shaped cross sectional shape including top surface 95 and downward extending legs 96 and 98. A plurality of guide pins 97 extend through both legs 96 and 98 of movable support means 94 and through the upright wall portion 100 of lower frame 84. A coil compression spring 101 surrounds that portion of each guide pin 99 between beam 94 and the upright wall portion 100 of lower frame 84, and the end heads 102 and 104 of the guide pins 99 limit the movement of the beam 94 away from the upright wall portion 100. Thus, springs 101 bias the movable support means 94 to the position illustrated in FIGS. 4 and 5.

Gripping bar 105 comprises a channel-shaped beam 106 which includes top wall 108, side wall 109 and bottom wall 110. Rectangular support beam 111 is mounted to the side wall 109 of channel beam 106 and supports the channel beam as illustrated. A plurality of pneumatic cylinders 112 are mounted to the top wall 108 of channel beam 106, and clamp bar 114 is supported by the cylinder rods 115 of cylinders 112. The clamp bar 114 is rectilinear and includes a rectilinear slot 116 in this lower surface, and an elongated elastic tube 118 fits in the slot. The arrangement is such that the clamp bar 114 and its tube 118, functioning as an upper clamp member, are moved toward and away from the bottom wall 110, which functions as a lower clamp member, whereby the assembly functions as a gripping means.

As illustrated in FIG. 2, gripping bar 85 is mounted at its ends on trolleys 119 and 120, with each trolley being supported by its wheels 121 on a track 122. A continuous chain drive 124 comprising chain 125, end sprockets 126 and 128 and air motor 129 function to move each trolley 119 and 120 along their tracks 122. Trolley 119 moves adjacent the end of work table sections 72*a* and 74*a* while trolley 120 moves through the passageways 79 and 80 between the work table sections 72*a*, 72*a*, and 74*a* and 74*b*. Thus, gripping bar 85 can be moved back and forth across cutting station 32 from the entrance thereof 83 to the other side thereof, 87. It will be noted that the clamp assembly 105 is long enough so that it extends beyond the trolley 120 and beyond the passages 79 and 80 formed in the work table assembly.

Figure 4:
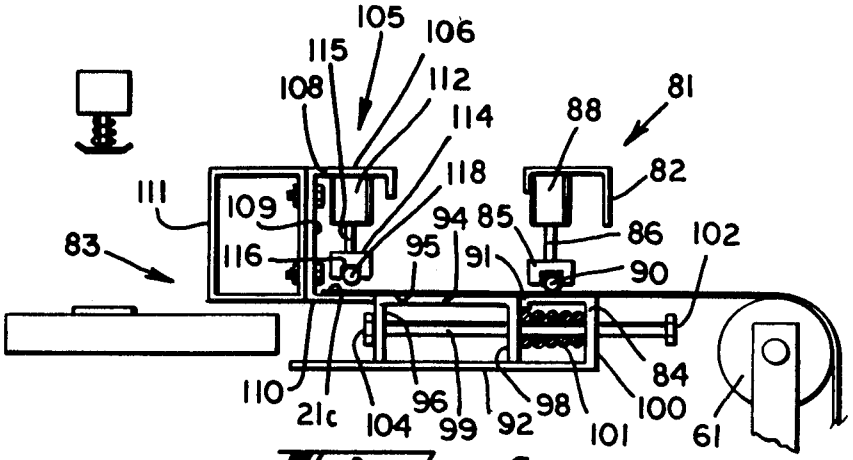
FIGS. 4–6 are progressive schematic side elevational views of the cutting station, with FIGS. 4 and 5 illustrating how the sheet material is gripped and pulled across the cutting station, with FIG. 5 illustrating how slack is formed in the sheet material, and with FIG. 6 illustrating how the segment of sheet material in the cutting station is cut from its supply and how the conveyor tapes and conveyor clamps function to move the cut segment from the cutting station toward the expansion station.

As illustrated in FIG. 4, when gripping means 105 moves from its home position 88 across the cutting station 32 to the entrance 83 of the cutting station, it moves into abutment with the movable support means 93, with the lower clamp member 110 abutting the leg 96 of the movable support means 94. This causes the movable support means to move against the bias of its springs 101, so that the lower clamp member 110 moves in beneath the leading edge portion 21*c* of the sheet material 21. When the gripping bar 105 is in this position the upper clamp member 114 is moved down by its pneumatic cylinders 112 so that the leading edge portion 21*c* of the sheet material is gripped between the upper clamp member 114 and the lower clamp member 110. When the gripping bar then begins its movement from the entrance 83 back to its home position 88, it pulls the sheet material 21 with it. In the meantime, clamp assembly 81 opens so as to allow the sheet material 21 to pay out and move with clamp assembly 105.

As illustrated in FIG. 2, the framework of the work table assembly 71 includes parallel support beams 134 and 135 which extend from cutting station 32 through hem expansion station 39 to hemming station 40. The parallel support beams 134 and 135 are supported over work tables 72 and 74, and conveyor tape clamp bars 136 and 138 are supported from the support beams 134 and 135. Pneumatic cylinders 139 are spaced along support beam 134, and the cylinder rods 140 are connected to the support clamp bar 136, while pneumatic cylinders 141 are spaced along support beams 135 and their rods 142 are connected to and support conveyor tape clamp bar 138. The clamp bars 136 and 138 are positioned over the conveyor tapes 76 and 78 and are movable by their cylinders 139 and 141 down toward and abutment with the conveyor tapes. Thus, when sheet material 21 is extended across the cutting section 32 by gripping bar 105, the clamp bars 136 and 138 are movable down into engagement with the sheet material to urge the sheet material into frictional contact with the conveyor tapes, so that when the conveyor tapes begin their movement, the sheet material will be moved with the conveyor tapes.

Clamp bars 136 and 138 are broken into sections 136*a* and 136*b*, and 138*a* and 138*b*, with the sections 136*a* and 138*a* extending over the passages 79 and 80 between the segmented work table assembly, so that the end portions of the clamp bars 136*a* and 138*a* span the passageways 79 and 80. The sections 116*b* and 138*b* are aligned with the sections 136*a* and 138*a*.

Figure 5:
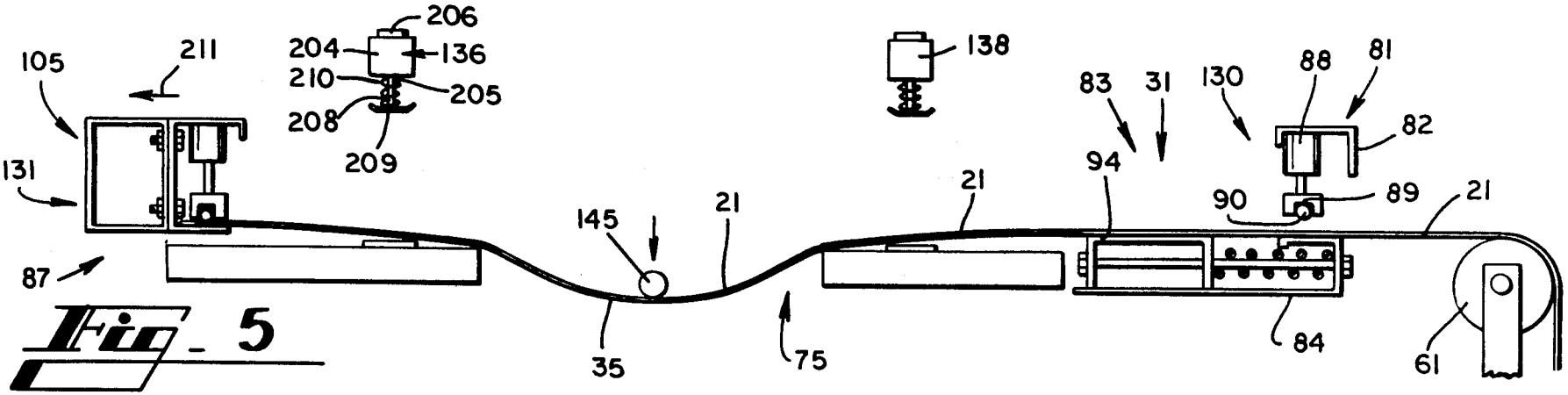

Slack bar assembly 144 is mounted on support beam 135 and includes rectilinear slack bar 145 that extends parallel to conveyor tapes 76 and 78 and which is located in the central open space 75 between the halves of the work table assembly, and L-shaped support legs 146 and 148, and rear connector bar 149. Clevises 150 and 151 pivotally connect the L-shaped support legs 146 and 148 to support beam 135. Pneumatic cylinders 152 and 153 are mounted at the ends of rear connector bar 149 and function to pivot the slack bar assembly 144 about support beam 135, so that its slack bar 145 moves down into the plane of the sheet stretched across the central open space 75 (FIG. 5).

Figure 3:
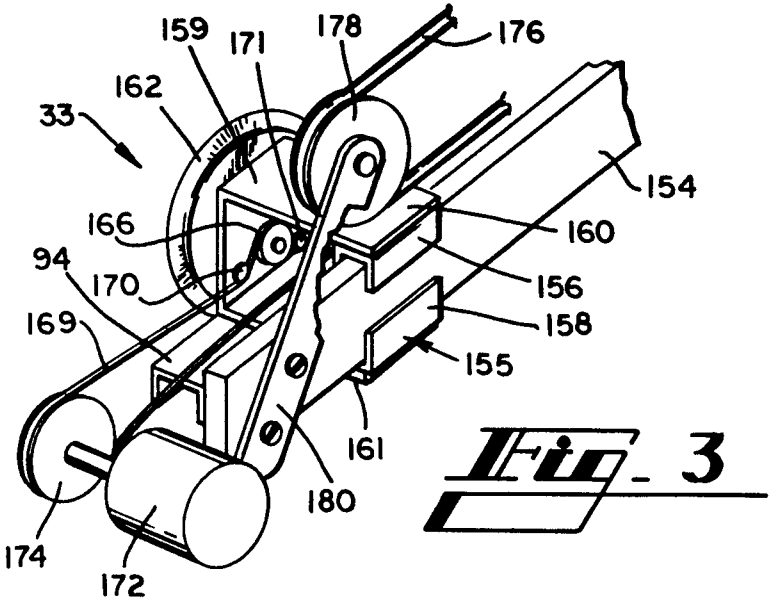
FIG. 3 is a perspective detail illustration of the cutter.
Figure 6:
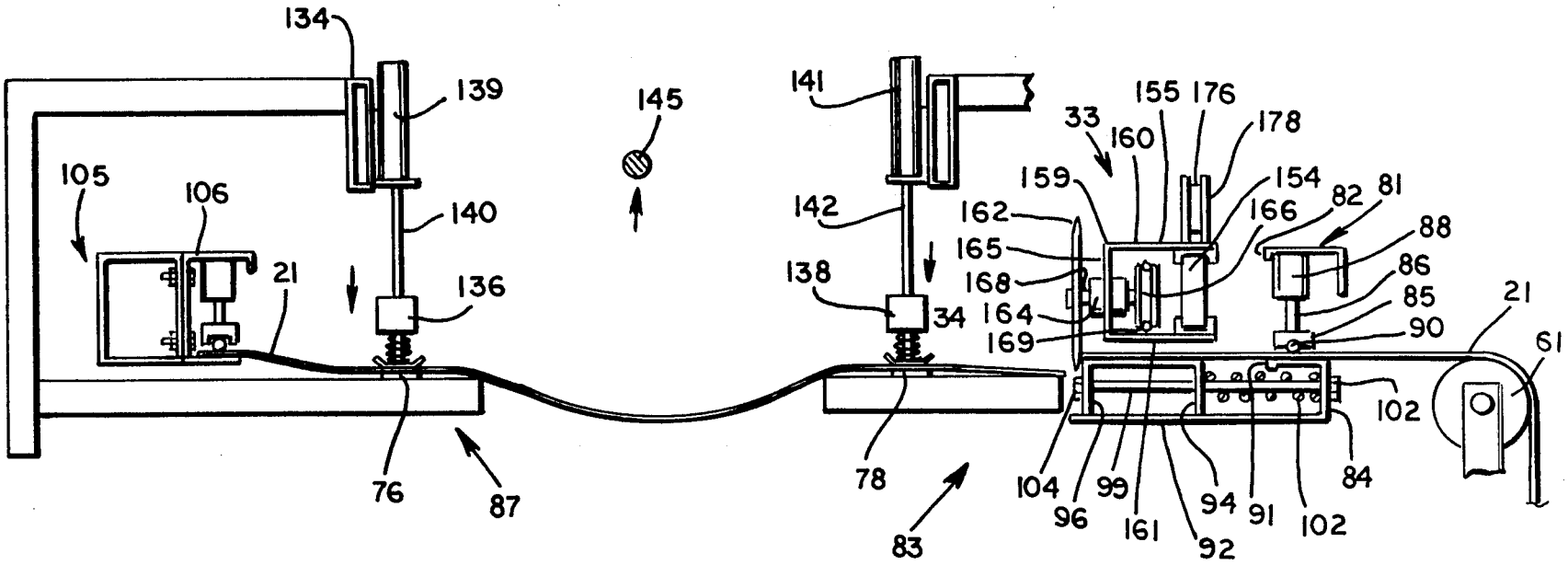
Figure 8:
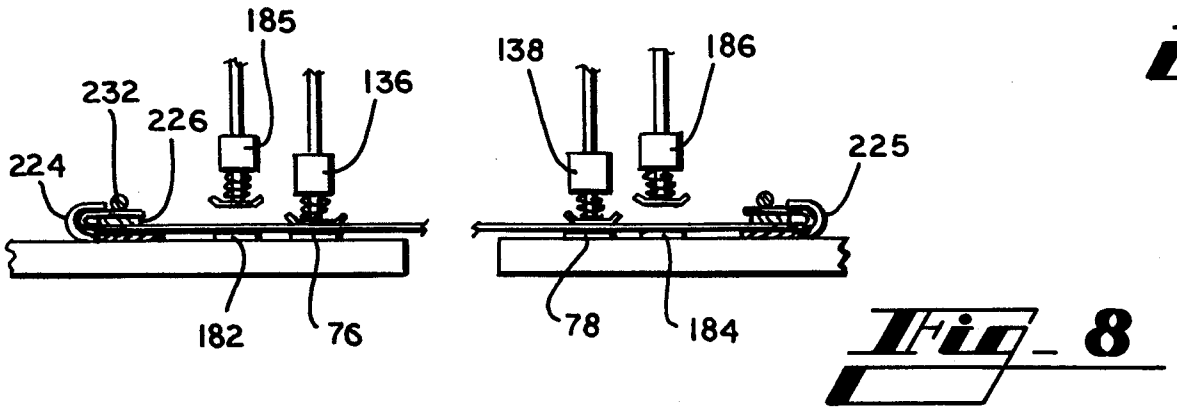

As illustrated in FIGS. 2, 3 and 6, cutter 33 comprises a rectilinear guide beam 154 which extends across the entrance 83 of the cutting station 32 at the movable support means 94. A carriage 155 is mounted on cutter guide beam 154 and includes upper and lower brackets 156 and 158 mounted about the upper and lower surfaces of guide beam 154, and U-shaped housing 159 having its upper and lower legs 160 and 161 mounted to brackets 56 and 158. Cutter disc 162 is mounted, by means of bearing 164, in the side wall 165 of U-shaped housing 159, with the axis of rotation of the cutter extending in a horizontal plane and with disc 162 extending in a vertical plane. A drive pulley 166 is connected to the disc drive shaft 168, and drive band 169 extends about pulley 166. A pair of idler pulleys 170 and 171 direct the guide band 169 around approximately 180° of the drive pulley 166, causing the drive band to frictionally engage and rotate drive pulley 166. Reversible electric motor 172 is mounted at the end of cutter guide beam 154, and its driven pulley 174 has drive band 169 wrapped therearound. The band is also wrapped around idler pulley 175 (FIG. 2) at the other end of the cutter guide beam 154. Thus, when electric motor 172 is energized, the movement of band 169 along its length causes disc 162 to rotate.

Carriage conveyor belt 176 is mounted at its ends about pulleys 178 and 179, and the pulleys 178 and 179 are mounted to the ends of cutter guide beam 154 by means of support straps 180. Reversible air motor 181 has its output shaft connected to pulley 179 and is arranged to drive carriage conveyor belt 176. Carriage conveyor belt 176 is connected to the top surface of carriage 155, so that movement of the carriage conveyor belts causes carriage 155 to traverse cutter guide means 154 and move cutting disc 162 across the sheet material.

As is illustrated in FIGS. 2, the second pair of conveyor tape assemblies 182 and 184 are located in the hem expansion section 39 of the assembly, with the conveyor tape assemblies 182 and 184 being located parallel to and outside the conveyor tapes 76*b* and 78*b*. Conveyor tape clamp bars 185 and 186 are located over conveyor tapes 182 and 184, with the pneumatic cylinders 188 and their rods 189 supporting clamp bar 185 and with the pneumatic cylinders 190 and their rods 191 supporting clamp bar 186. The clamp bars 185 and 186 are supported directly over conveyor tapes 182 and 184 and are movable down toward and up away from engagement with the conveyor tapes and the sheet material carried thereon.

As illustrated in FIG. 5, the conveyor tape clamp bars, such as clamp bars 136 and 138, each include a rectilinear bar 204, a plurality of vertical holes formed vertically through the bar (not shown), and pins 205 extending downwardly through the holes of the bar, with the heads 206 of the pins resting on the upper surface of the bar 204, and with the stems 208 extending down beneath the bars 204. A slide or foot 209 is mounted on the bottom of pins 208, and a coil compression spring 210 surrounds each pin 208 beneath bar 204, and biases the foot downwardly away from the bar 204. The conveyor tape clamp bars 136 and 138 are moved to their up positions by their cylinders 139 and 141 when gripping means 105 moves as indicated by arrow 211 away from the entrance 83 of the cutting station 32 to its home position 87. After the gripping member has reached its home position 87, the clamp bars 136 and 138 move down toward engagement with the sheet material 21, over conveyor tapes 76 and 78. Cutter 33 is then energized, by air motor 181 moving carriage conveyor belt 176, causing the carriage 155 and disc cutter to move along the length of cutter guide beam 154. In the meantime, electric motor 172 is energized to move its drive band 169 about drive pulley 166 of disc cutter 162, causing disc cutter 162 to rotate. Thus, the sheet material will be cut by cutter 33 when gripping means 105, clamp bars 136 and 138 and clamp assembly have all engaged the sheet material 21, thereby holding the sheet material in a stable condition.

After the cutter has completed the cut across the sheet material to form the cut segment 34, gripping means 105 releases the sheet material 21 and the conveyor tapes 76 and 78 begin their movements, to move the cut segments 34 in a direction parallel to the cut ends of the segment from the cutting station 32 to the hem expansion station 39.

HEM FORMING AND EXPANSION ATTACHMENT

Figure 7:
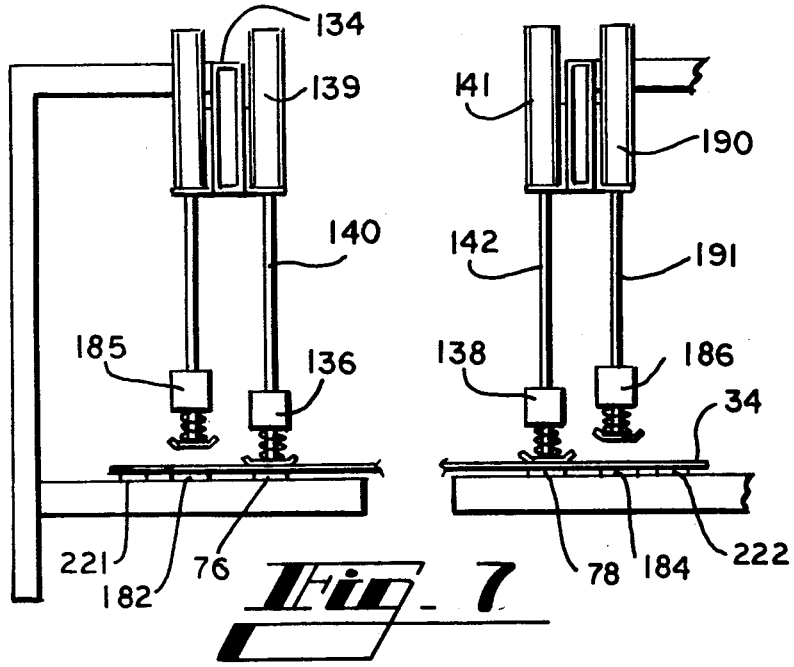
FIGS. 7–9 are progressive schematic illustrations of the entrance to the expansion station, with FIG. 7 illustrating how the sheet material is moved to the expansion station and with FIGS. 8 and 9 illustrating how the opposite cut edge portions are initially folded.

Conveyor tapes 76*a* and 76*b* (FIGS. 2, 5 and 6) move the cut segment 34 of sheet material from the cutting station 32 on into the hem expansion station 39. Outside conveyor tapes 221 and 222 move up into supporting relationship from the work table (FIGS. 7 and 13) to support the cut edge portions of the cut segment as they enter folders 224 and 225.

Figure 13:
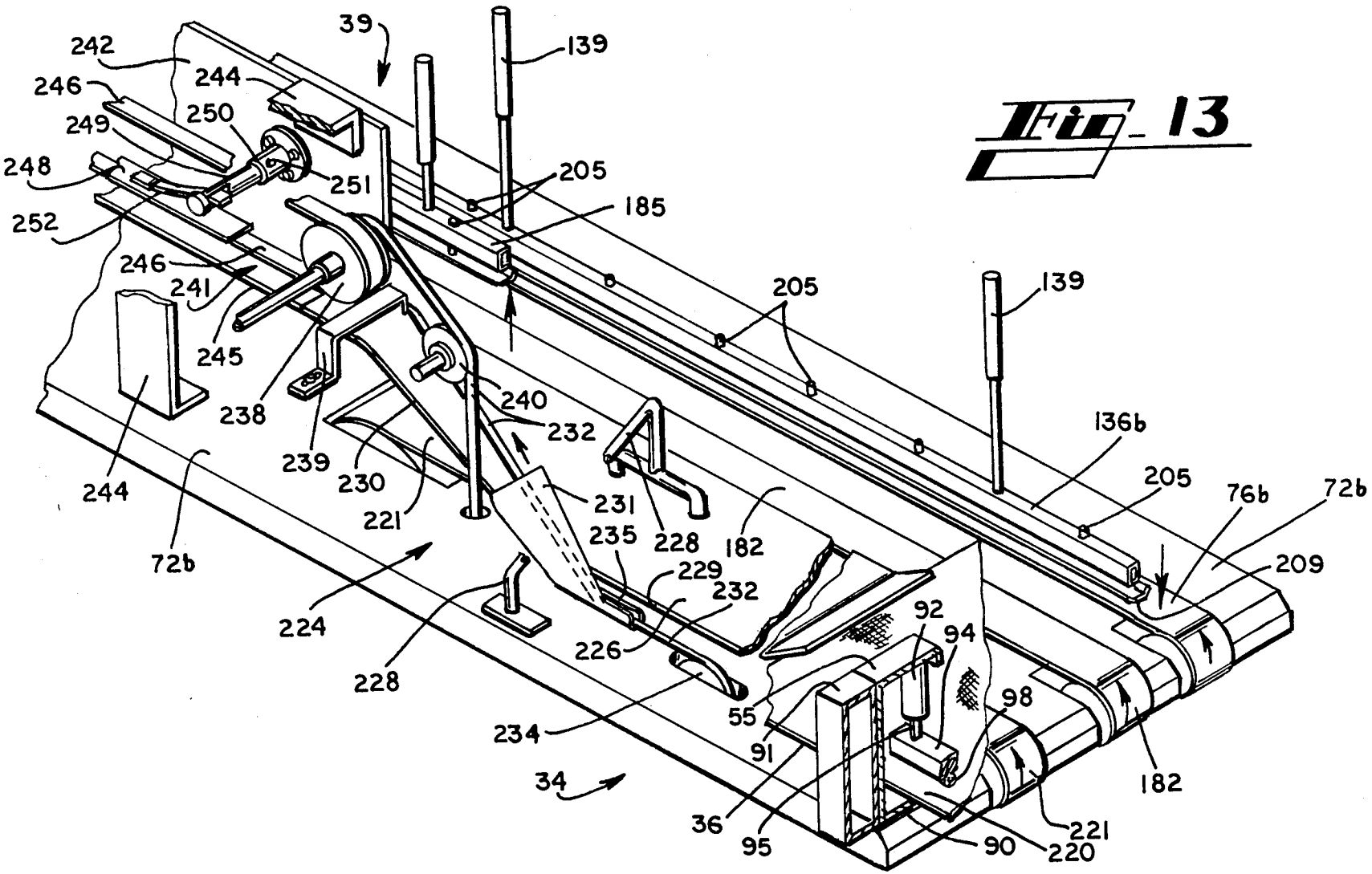
FIG. 13 is a perspective illustration of the folder which forms the hem at the head of the bed sheet as the sheet moves from the cutting station into the expansion station.

As illustrated in FIG. 13, each folder includes a fold finger 226 that is supported in parallel, spaced relationship with respect to the work surface of the work table by support bracket 228, and includes an edge 229 that extends approximately parallel to the cut edge 36 of the cut segment 34 of sheet material, and an angled edge 230. Stationary edge folder 231 is attached to the work surface and extends upwardly and curves about edges 229 and 230, and generally conforms to the shapes and angles of the edges 229 and 230. The stationary edge folder functions like a plow in that it lifts and turns over the cut edge portion 220 of each segment 34, so that the cut edge portion is folded over and on top of fold finger 226. The shape of edge folder 231 causes the material to be progressively moved onto the fold finger 226.

As illustrated in FIG. 13, folding band 232 moves upwardly from its sheave 234 through an opening in the work surface and moves into the edge folder 231. The edge folder 231 includes a slot 235 into which the band initially moves, and the band 232 is guided over the edge 229 of the fold finger 226 and extends at an angle inwardly of the angled edge 230 of the fold finger. Pulley 237 is located at the end of fold finger 226 and takes up folding band 232. Guide bracket 239 is located immediately in front of the sheave of pulley 237 that receives folding band 232, assuring that the band tracks directly toward the groove of the pulley 238. On its return flight, folding band 232 is guided over fold finger 226 by sheave 240, then moves downwardly through an opening in the work surface, about another guide pulley (not shown), back to sheave 234. The guide pulley below the work surface is driven to impart movement to the folding band. The arrangement of folding band 232, fold finger 226 and outer belt 221 causes the cut edge portion 220 of the segment of sheet material to be progressively and positively folded over into overlying relationship with respect to the body portion of the segment of sheet material.

Figure 14:
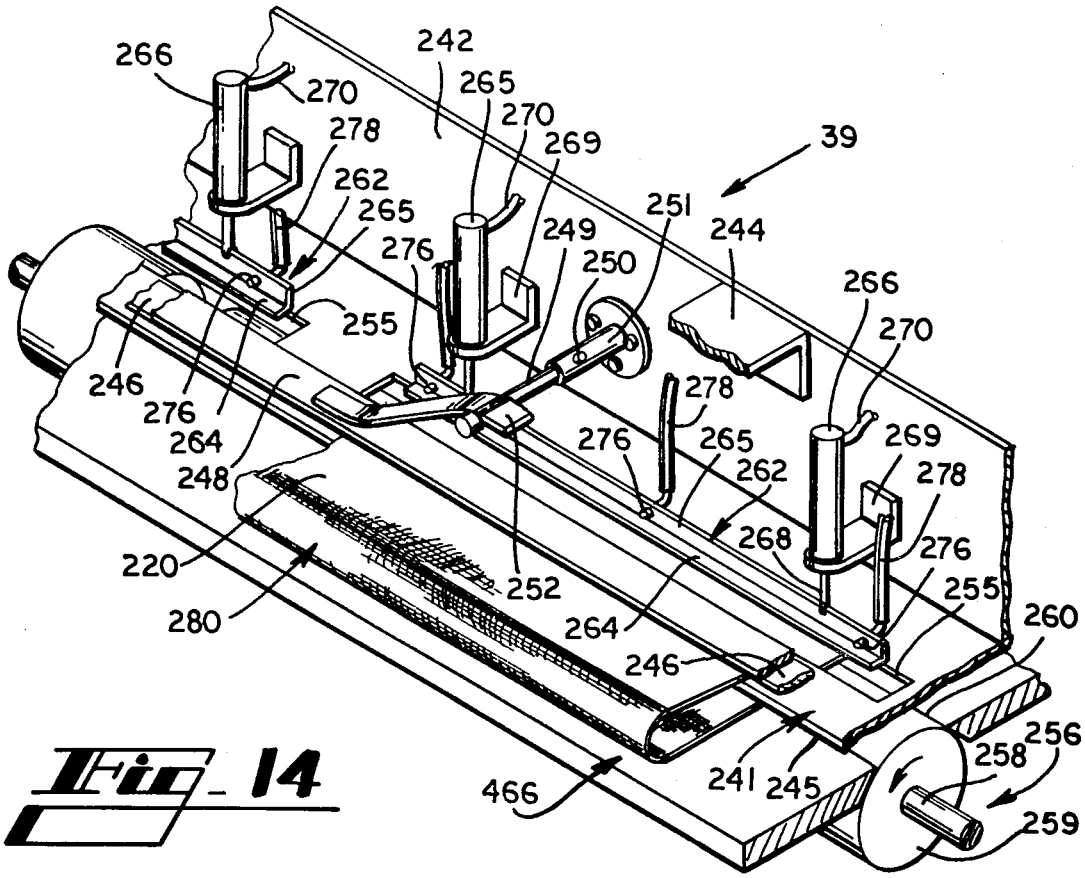
FIG. 14 is a perspective detail illustration of a portion of the hem expander attachment.

As illustrated in FIGS. 13 and 14, fold platform 241 is also supported in spaced, parallel relationship with respect to the work surface 72*b*, by means of vertically extending support plate 242 connected at its lower edge to an edge of the fold platform 241, and by L-shaped support brackets 244 attached to the upper portion of the vertical support plate 242 at spaced intervals along its length, and to work table 72*b*. Fold platform 241 includes a retilinear folding edge 245 that extends the entire length of hem expansion section 39, and fold finger 226 abuts the entrance end of fold platform 241, so that the angled edge 230 of fold finger 226 merges with the rectilinear edge 245 of fold platform 241. Thus, the cut edge portion 220 of the segment of sheet material 34 moves off fold finger 226 onto fold platform 241.

As illustrated in FIG. 13, platform belt 246 extends about pulley 238, and pulley 238 moves the platform belt down into engagement with the cut and fold over edge portion 220 of the sheet material as the cut edge portion moves on the upper surface of fold platform 241. Platform belt clamp 248 is positioned over fold platform 241 and is located on top of the lower flight of platform belt 246. A plurality of support rods 249 are mounted to vertical support plate 242 and extend horizontally between the upper and lower flights of platform belt 246, outwardly over the platform belt clamp 248. Each support rod 249 is rotatably supported in its mount 250, and a set screw 251 extends through the mount 250 and holds the support rod 249 in place. The distal end of each support rod 249 is bifurcated, and a leaf spring 252 extends through the slot of the bifurcated distal end. Each leaf spring is also rigidly connected at one of its ends to the upper surface of platform belt clamp 248. Thus, the platform belt clamp is supported at spaced intervals along its length by the leaf springs 252 and support rods 249 and their mounts 250 from vertical support plate 242.

When more or less downward force is to be applied by the platform belt clamp 248 against the platform belt 246, the set screws 251 can be loosened and the support rods 249 turned to change the force applied to the leaf springs 252. Thus, the platform belt 246 exerts a moving clamp action to the cut edge portion 220 of the cut segment of sheet material 34 as the cut segment moves along fold platform 241, thus holding the cut edge portion from movement in a direction across its cut edge as the cut edge portion moves along the fold platform 241. Platform belt 246 is driven at the same linear speed as band belt 76 as the cut segment of sheet material moves into the hem expansion section 39, thus assuring that no wrinkles will be formed in the sheet material.

As illustrated in FIGS. 10–12 and 14, a plurality of slots 255 are formed in fold platform 241 at spaced intervals along the length of the fold platform. The slots 255 are elongated and are aligned with one another along the length of fold platform 241. Slots 255 are positioned between vertical support plate 242 and platform belt 246 and its clamp 248. An elongated roller assembly 256 is located beneath the surface of work table **72*b* and includes an axle 258 extending parallel to slots 255, and a plurality of bands 259 are mounted on axle 258 at spaced intervals along the length of the axle. The bands 259 are located beneath the slots 255 in fold platform 241. The bands 259 are also located in slots 260 formed in work table 72*b*, with the slots 260 being positioned beneath the slots 255 in fold platform 241**.

A plurality of expansion clamps 262 are suspended above fold platform 241 over slots 255 in the fold platform. Each expansion clamp 262 is L-shaped in cross section and includes horizontal leg 264 and vertical leg 265. Each expansion clamp 262 is of a length and width slightly less than the length and width of the slot 255 in fold platform 241. Each expansion clamp 262 is supported by cylinders 266 and their rods 268, with the cylinder rods being attached to the vertical leg 265 of a clamp 262. Each cylinder 266 is mounted by means of a bracket 269 to vertical support plate 242, and the cylinders 256 include an internal coil compression spring (not shown) that holds its cylinder rod 268 in a retracted, up position. Controlled air pressure communicates with the upper end of each of the cylinders 266 through conduits 270. Thus, cylinders 266 function to reciprocate expansion clamps 262 between a position where the expansion clamps 262 are retracted above the slots 255 of fold platform 241 (FIGS. 10, 12 and 14) and to a position where the expansion clamps are moved downwardly through the slots 255 in fold platform 241 and bear against the upper surfaces of elongated roller assembly 256 (FIG. 11).

Figure 11:
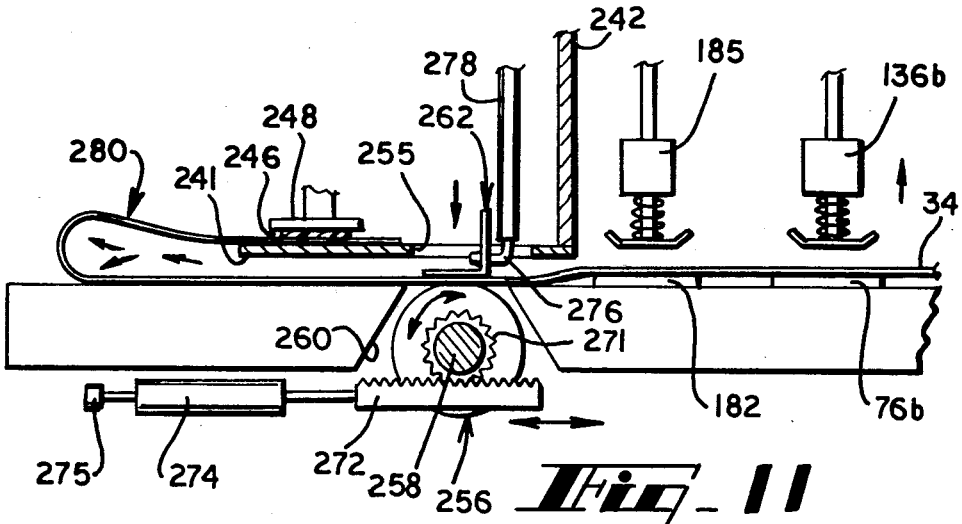

As illustrated in FIG. 11, elongated roller assembly 256 includes a drive sprocket 271 mounted on its axle 258 and a rack 272 engages the teeth of sprocket 271. Rack 272 is reciprocated by cylinder 274 so as to drive elongated roller assembly 256. The angle through which roller assembly 256 rotates is adjustable and is controlled by a positioning screw 275 in the end of cylinder 274.

Figure 12:
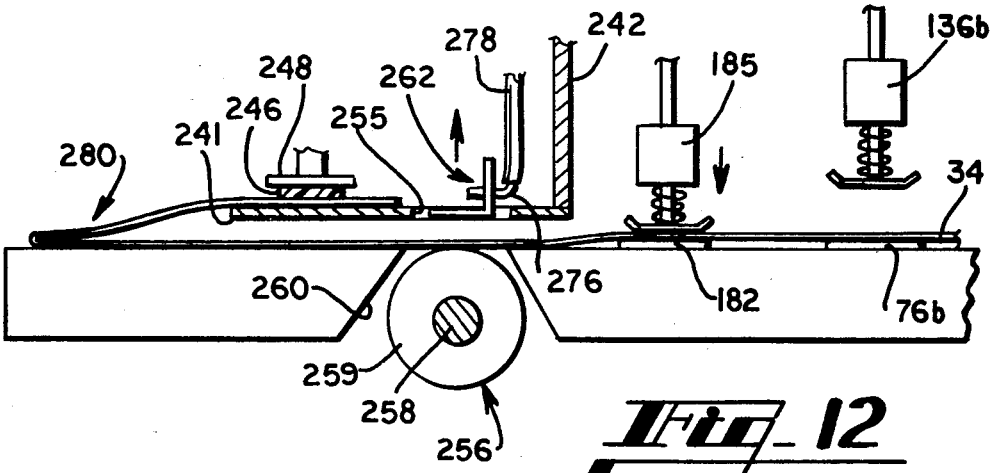

As illustrated in FIGS. 11, 12 and 14, a plurality of air nozzles 276 are mounted on expansion clamps 262, as by extending each nozzle 276 through the vertical leg 265 of the expansion clamps, so that the nozzles 276 are directed approximately parallel to the horizontal legs 264 of the expansion clamps. Flexible conduits 278 connect each nozzles 276 to a source of air pressure.

Figure 10:
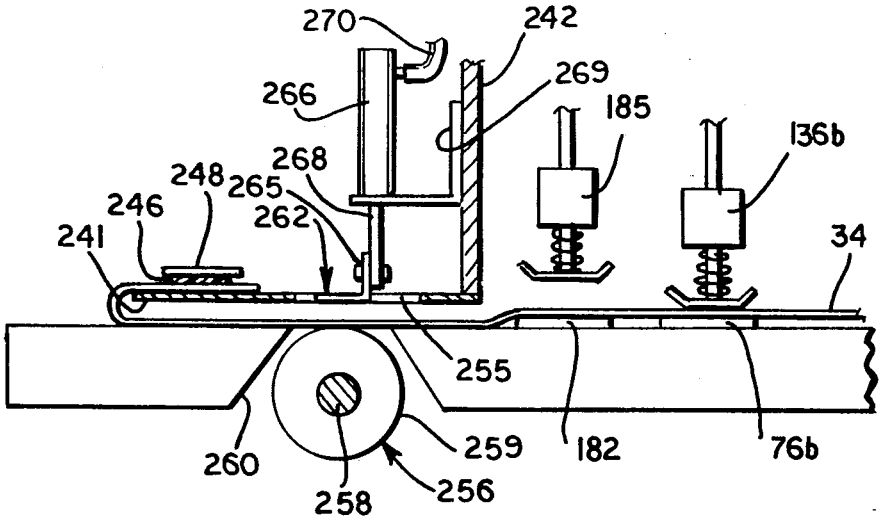
FIGS. 10–12 are progressively schematic illustrations of the hem expander, with FIG. 10 illustrating the movement of the sheet material through the hem expansion station, with FIG. 11 illustrating the way in which the hem is expanded, and with FIG. 12 illustrating the way in which the sheet material is moved beyond the hem expansion station.

When the cut segment of sheet material 34 has been moved by conveyor tapes **76*b* along the work table and by platform belt 246 along fold platform 241 a distance sufficient to move the entire cut segment of sheet material entirely into fold expansion section 39, as determined by a photocell (not shown) in the path of the sheet material, the movements of conveyor tape 76*b* on the work table and of the platform belt 246 on fold platform 241 momentarily terminate (FIG. 10). Then cylinders 266 move expansion clamps 262 in a downward direction through slots 255 in fold platform 241 until the horizontal legs 264 of the expansion clamps have urged the body portion of the segment of sheet material into engagement with roller assembly 256 (FIG. 11). Immediately thereafter conveyor tape clamp 136*b* is raised away from conveyor tape 76*b* on work table 72*b* and roller assembly 256 is rotated by its sprocket and rack 271, 272 (FIG. 11), moving its upper surface toward the fold in the sheet material. The raising of conveyor tape clamp 136*b* frees the body portion of the sheet material, while the rotation of the roller assembly 256 provides a moving surface against which the expansion clamp 262 has clamped the body portion of the sheet material. Thus, the body portion of the segment 34 of sheet material is pulled toward the fold in the sheet material. In the meantime, air is moved through conduits 278 leading to nozzles 276 carried by expansion clamps 262. This provides a flow of air directed beneath the fold platform 241 (FIG. 11), into the hem. Thus, the portion of the sheet material pulled by the roller assembly 256 toward the fold in the sheet material will be expanded by means of air pressure, resulting in an expansion of the hem previously formed by folder 224**.

After the fold in the sheet material has been expanded in the manner illustrated in FIG. 11, hemming clamps 185 and 186 are moved downwardly toward engagement with the body portion of the cut segment of sheet material 34, to clamp the sheet material against hemming belts 182 (FIG. 12) and immediately thereafter the expansion clamps 262 are raised away from roller assembly 256, upwardly through the slots 255 in fold platform 241. The now expanded fold 280 in the cut edge portion of the segment of sheet material and the body portion of the segment are moved by converyor tape 182 and by platform belt 246 on toward hemming station 40. Platform belt 246 is now moved at the same linear velocity as hemming belt 182.

HEMMING STATION

Figures 9, 15:
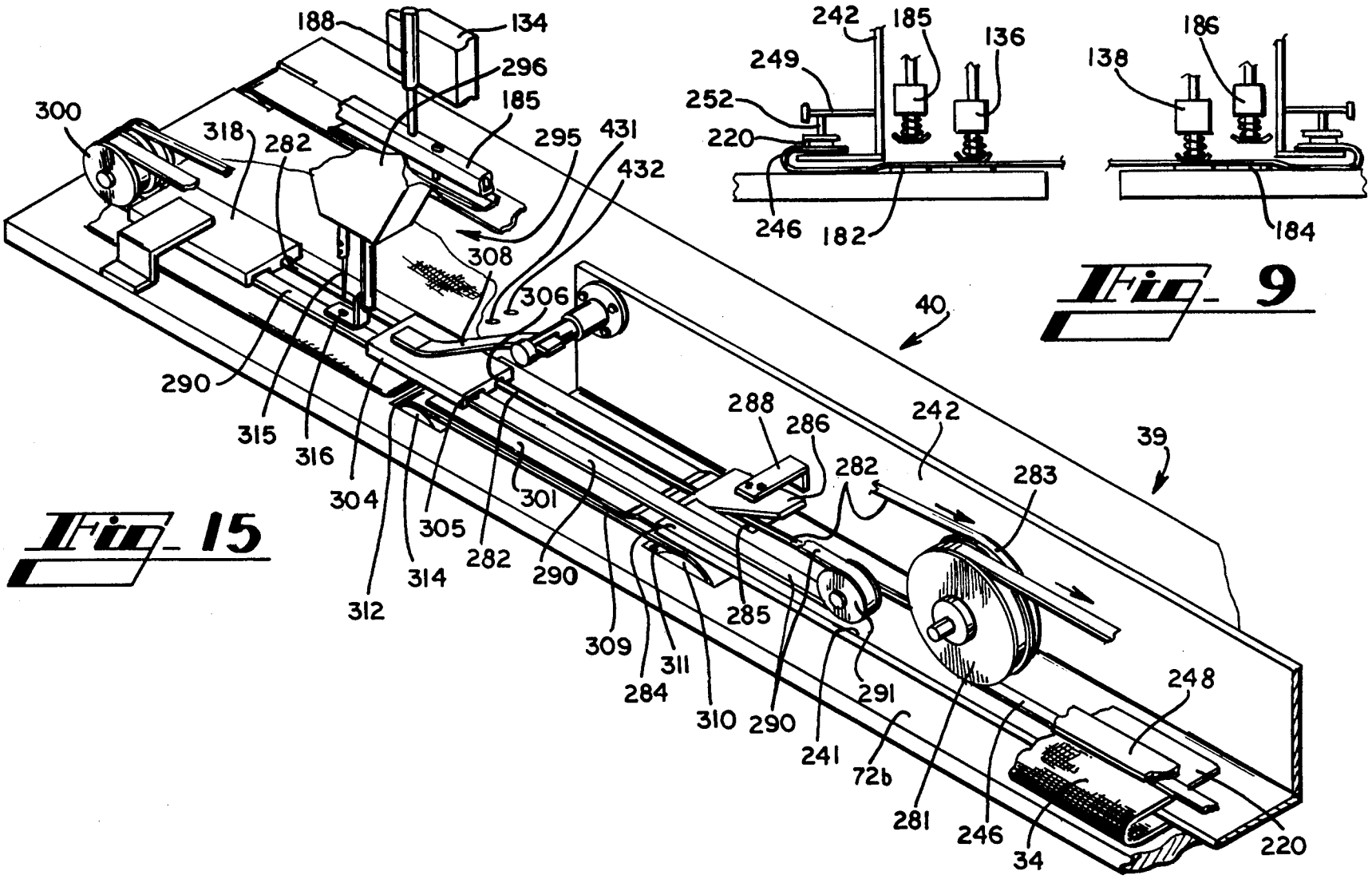
FIG. 15 illustrates the end portion of the hem expansion attachment and the sewing station and its control means for carrying the folded hem of the sheet material on through a sewing machine.
Figure 16:
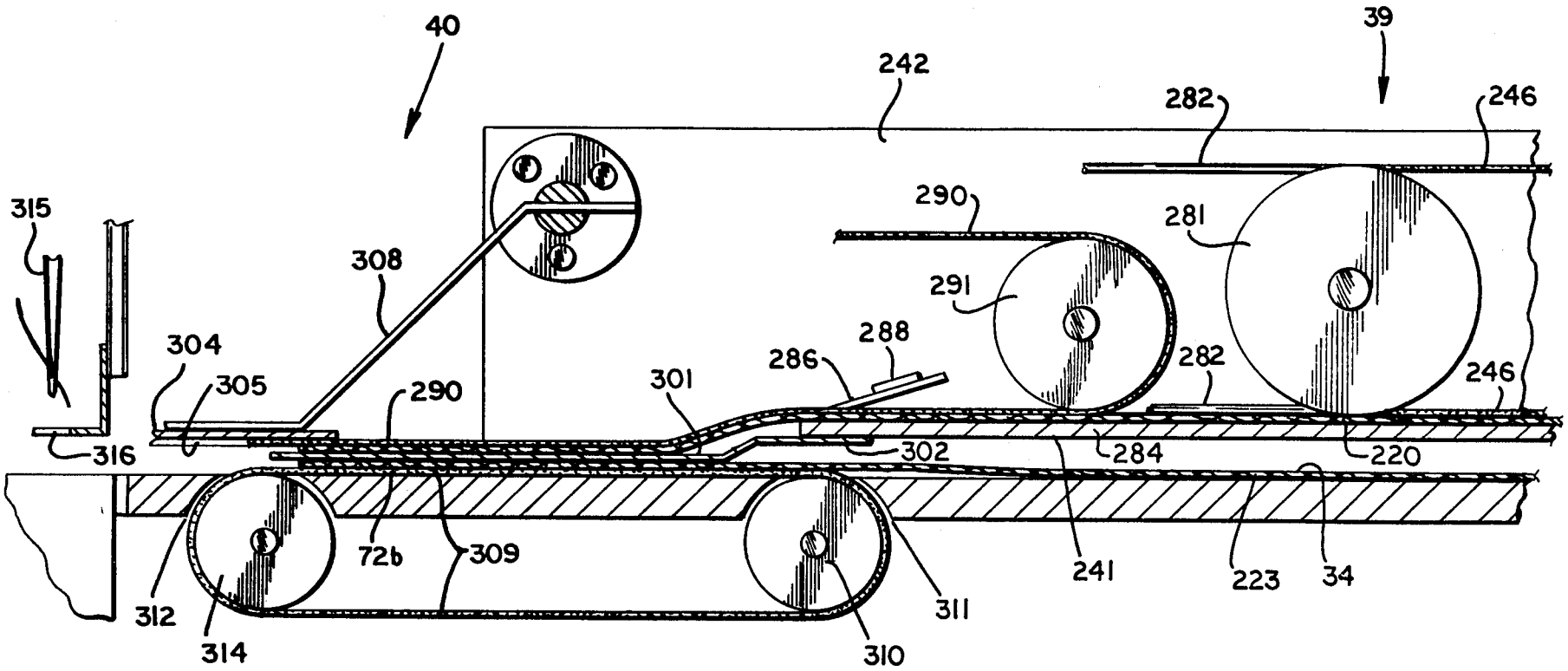
FIG. 16 is a side view of the end portion of the hem expansion attachment and a portion of the sewing station.

As illustrated in FIGS. 15 and 16, the segment of sheet material 34 moves from the hem expansion section 39 on into the hemming section 40, by the segment moving out from beneath platform belt 246. Platform belt 246 is taken up by pulley 281. Folding band 282 extends about pulley 283 which idles on the same shaft as pulley 281 and folding band 282 is moved down into engagement with the folded edge portion of the sheet material and continues the movement of the sheet material along fold platform 241. Fold platform 241 includes fold finger projection 284 that extends coextensively with the fold platform 241, and is formed by notch 285 in the fold platform. Overlapping fold finger 286 is supported by bracket 288 from vertical support plate 242, and overlapping fold finger 286 projects into the notch 285 and extends beneath fold finger projection 284. Folding band 282 moves through notch 285 and beneath overlapping fold finger 286 and moves on through the sewing machine 296 to compound pulley 300. In the meantime, stabilizing belt 290 is applied to the fold in the sheet material by its put-down sheave 291, runs off the end of fold finger projection 284, and is taken up by compound pulley 300. The fold finger projection 284, overlapping fold finger 286 and folding band 282 function to form the second fold in the cut edge portion of the sheet material, tucking the raw edge of the sheet material beneath the large fold. Folding band 282 assures that the leading edge of an oncoming segment 34 of sheet material moves beneath overlapping fold finger 286, and overlapping fold finger 286 tucks the raw edge beneath fold finger projection 284.

When the segment of sheet material 34 emerges from the final folder, the now folded cut edge portion of the segment of sheet material moves into hemmer 295. Hemmer 295 comprises sewing machine 296 and entrance and exit guide plates 304 and 318 positioned over guide belt 290 and folding band 282. The guide plates each include downwardly facing slots such as slots 305 and 306 of guide plate 304 which conform to the shape of the band and belt, so as to guide and stablize the band and belt as they approach and move away from sewing machine 296. Leaf spring 308 holds entrance quide plate in its proper position and applies the proper tension thereto. Lower transport belt 309 moves upwardly through the work table from its pulley 310 and opening 311 and moves out from beneath fold platform 241 and then moves into its opening 312 in the work table about pulley 314 beneath entrance guide plate 304.

As illustrated in FIGS. 15 and 16, separator plate 301 is formed of thin sheet metal with smooth upper and lower surfaces and one end portion thereof 302 is attached in overlying relationship to the lower surface of fold platform 241. The flexible separator plate extends beyond the end of rigid fold platform 241 and continues the separation of the folded layers of the segment 34 of sheet material; however, stabilizing belt 290 and folding band 282 apply downward force against the layers of the folded over edge portion 220 of the segment 34, the separator plate 301, the unfolded body portion 223 of the segment 34, the lower transport belt 309 and the surface **72*b* of the work table, so that the lower transport belt controls the movement of the unfolded body portion 223 of the segment adjacent the fold in the segment and the belt 290 controls the movement of the folded over edge portion 220. Thus, the sheet material is accurately and positively transported from fold platform 241 on through sewing machine 296**.

Sewing machine 296 is a single needle sewing machine, and its needle 315 is arranged to sew through its presser foot 316 and between band 282 and belt 290, through the three layers of the hem formed in the sheet material. The exit guide plate 318 which is similar to entrance guide plate 304 also stabilizes and quides band 282 and belt 290 as they move away from sewing machine 296. When the trailing edge of the segment of sheet material moves beyond sewing machine 296, the force applied by exit quide plate 318 to band and belt 282 and 290 keeps the trailing edge of the now sewn segment of sheet material from being snatched away from the sewing machine, causing the trailing edge to be moved gradually away from the sewing machine until it has emerged from compound pulley 300.

DRIVE SYSTEM

Figure 17:
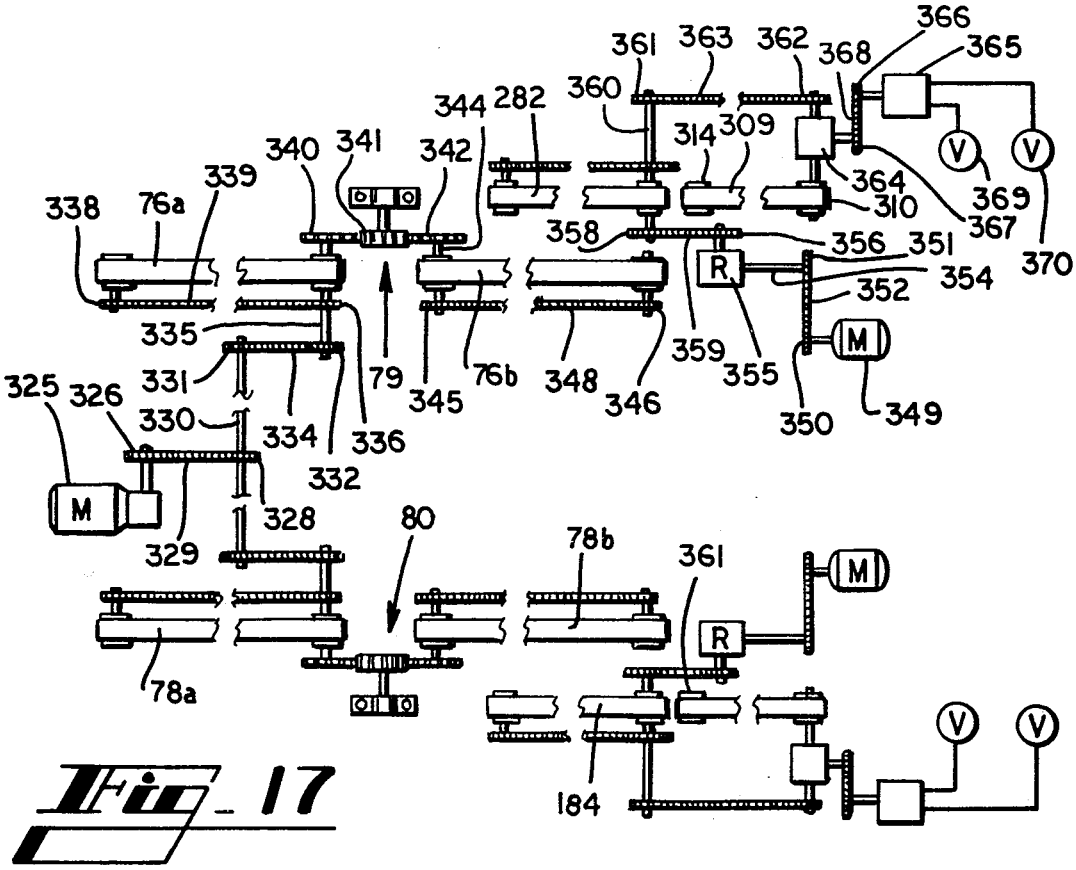
FIG. 17 is a schematic illustration of the drive system for the cutting, expansion and hemming stations.

As illustrated in FIG. 17, the drive system for the conveyor tapes in the cutting section comprises motor 325 which drives through sprockets 326 and 328 and chain 329 to rotate drive shaft 330. The drive systems for each conveyor tape are similar and include drive sprockets 331 and 332 with their connecting chain 334, shaft 335, sprockets 336 and 338 and their connecting chain 339, and conveyor tape **76*a* and 78*a*. Shaft 335 also extends through conveyor tape 76*a* and 76*b* to gear 340 which is connected through gears 341 and 342 to shaft 344 which drives conveyor tape 76*b* and 78*b*, sprockets 345 and 346 and their connecting chains 348**.

The hemmer drives are similar to each other and each includes a motor 349, drive pulleys 350 and 351 and their connecting belt 352, drive shaft 354, gear reducer 355, sprockets 356 and 358 and their connecting chain 359 and conveyor tape 182.

Lower transport belt 309 which carries the lower surface of the segment 34 of sheet material from the fold platform to the needle of the sewing machine is driven by shaft 360 acting through sprockets 361 and 362 and belt 363 to drive phase shifter 364, and phase shifter 364 drives driven pulley 310 of transport belt 309. Air motor 365 control phase shifter 364 through its sprockets 366 and 367 and control chain 368. Valves 369 and 370 control air motor 365, to cause an increase or decrease from the output shaft of phase shifter 364, causing lower transport belt 309 momentarily to move faster than or slower than hemming belt 182, hemming guide band 301 and hemming stabilizing belt 302, to shift the lower transport belt 309 ahead or behind the hemming belt 182, the hemming guide band 301 and the hemming stabilizing belt 302. Lower transport belt 309 therefore momentarily speeds up or slows down the movement of the body portion of the sheet material with respect to the folded over hem portion, so that the leading and trailing edges of the body and hem portions are formed in overlying relationship. With this arrangement, the leading and trailing edges of the hems being formed by the sewing machines, such as sewing machine 296, can be controlled so that no "dog ear" or protruding portion of the hem is permitted to be formed by the sewing machine.

CONTROL CIRCUIT

As illustrated in FIGS. **18*a* and 18*b***, three circuits are used to control the system. The first circuit is a 24 volt DC circuit, the second circuit is a 110 AC circuit and the third circuit is a 220 AC circuit.

The 24 volt DC circuit comprises main conductors 371 and 372, with conductor 371 being the negative conductor and conductor 372 being the positive conductor. A plurality of switches appear in the circuit and are termed timing switches. These switches are opened and closed by cams mounted on a rotatable cam shaft (not shown), with the cam shaft being driven by a timing motor.

Main conductor 371 is connected to conductor 373 (FIG. 18B), which includes first stop switch 374, first start switch 375, accumulator switch 376 and the coil of first control relay CR1. Also connected in parallel with start switch 375 is second start switch 378 and the second contact CR1-2 of the control relay CR1. Thus, the second contact CR1-2 forms a holding circuit through the coil of the control relay.

The coil of control relay CR1 in conductor 373 also closes the contact CR1-1 into 110 AC circuit (FIG. 18A), making a circuit from main conductor 379, through conductors 380, 381, timing motor TM and main conductor 382. When timing motor TM begins its operation, it immediately closes timing switch TS1, making a circuit from main conductor 379 through conductor 384, timing switch TS1, conductor 381, timing motor TM to main conductor 382. This causes timing motor TM to continue its operation. When considering this function in connection with FIG. 18, it will be seen that switches TS1 and TS2 are first to close and last to open. Timing switch TS2 makes a circuit from main conductor 371 through conductor 385 and then through main conductor 386. Thus, timing switch TS2 functions to energize a common conductor 386 to which most of the DC circuits are made.

Timing switch TS3 is in a circuit from common line 386 through conductor 388 through manual switch 389, to pilot valve V3 which causes air motor 129 to move the gripping bar 105 from its home position to the entrance position of the cutting station 32. In addition, in order to cushion the impact of the gripping bar 105 as it moves into the entrance 83 of the cutting station, valve V is energized parallel with pilot valve V3 through conductor 290 to charge a plurality of dash pots (not shown) which engage the oncoming gripping bar.

After gripping member 105 has reached the entrance of the cutting station 32, the cam system closes timer switch TS4 which makes a circuit from common line 386 through conductor 391, manual switch 392, and pilot valve V5 to main conductor 371. This causes the gripping bar to move its upper clamp member down against the lower clamp member 110 and to grip the leading edge portion 21*c* of the sheet material 21.

After the gripping bar is in gripping relationship with the leading edge portion of the sheet material, the clamp assembly 81 is moved up. This is accomplished by a cam on the cam shaft closing timer switch TS5 which makes a circuit from common 386 through conduct 394, through manual switch 395, through pilot valve V8 to main conductor 372.

As soon as the clamp assembly is up to release the leading edge portion of the sheet material, the gripping bar is moved from the entrance position at the cutting station back to its home position to pull the sheet on into the cutting station 32. This is accomplished by closing timer switch TS6 which makes a circuit from common 386 through conductor 394, manual switch 395 through pilot valve V4 to main conductor 372. Also, a circuit is made through conductor 396 to dash pots (not shown) through valve V. The dash pots cushion the impact of the oncoming gripping bar 105.

After the sheet material has been pulled into the cutting station by the gripping bar, the slack must be formed in the segment of sheet material by moving the slack bar 145 down into the sheet material. This is accomplished by a cam closing timer switch TS15 which makes a circuit from common 386 through conductor 428 to pilot valve V14 to main conductor 372.

After the gripping member reaches its home position and slack has been formed in the sheet, the clamp assembly 81 is again moved into clamping relationship with the sheet material to hold the sheet material stable for the subsequent cutting step. This is accomplished by a cam closing timer switch TS7 which makes a circuit from common 386 through conductor 398, manual switch 399 and pilot valve V7 to main conductor 372.

The first pair of conveyor tape bars 136 and 138 are moved down into engagement with the sheet material toward their respective conveyor tapes 76 and 78 at the same time the clamp assembly is moved down to clamp the sheet material. This is accomplished by a cam closing the timer switch TS8 which makes a circuit from common 386 through conductor 400, manual switch 401, through pilot valve V9 to main conductor 372. Pilot valve V9 causes the pneumatic cylinders 139 and 141 of the clamp bars to move the clamp bars down into engagement with the sheet material.

Now that the conveyor tape clamp bars, the clamp assembly and the gripping bars have all grasped the segment of sheet material extending through the cutting section 32, the disc cutter is actuated to cut across the sheet material. This is accomplished by a cam closing the timer switch TS9 which makes a circuit from common 386 through conductor 402, manual switch 404, and stepping switch 405 through either of conductors 406 or 408 to pilot valves V1 or V2 and to dash pot valves V which are in parallel with the pilot vlaves V1 and V2. Also, a parallel circuit is made through conductor 409 through the coil of stepping relay CR3 and through the coil of the blade run relay CR5. The contacts 405 of stepping relay CR3 move alternately to change conductor 406 or 408, to move the knife in one direction and then in the other direction. Also, control relay CR2 in the 24 volt circuit closes its contact CR2-1 in the 110 AC circuit, making a circuit from conductor 379 through conductor 410 to control relay CR4 to conductor 382. Control relay CR4 closes its contacts CR4-1 in the 220 AC circuit, or closes its contact CR4-2, causing the cutter disc motor 172 to reverse and begin operation.

As the cutter disc is making its cut through the sheet material, the gripping bar 105 releases the leading edge of the sheet material. This is accomplished by closing timer switch TS10 which makes a circuit from common 386 through conductor 412, through manual switch 414 to pilot valve V6 and main conductor 372.

After the cut in the sheet material has been completed and the gripping bar is opened, the first pair of conveyor tapes begin their movements to move the sheet material in a direction extending along the cut edges thereof to the transverse station. This is accomplished by closing timer switch TS11 which makes a circuit from common 386 through conductor 415, manual switch 416, through a photocell circuit 418, to pilot valve V13 to main conductor 372. Pilot valve V13 actuates motor 325 and motor 325 continues to run until the photocell P in photocell circuit 418 sees the oncoming edge of the sheet material, whereupon the circuit to pilot valve V13 is opened, thereby causing the sheet to stop.

When the cut segment of sheet material is moving from the cutting station 32 to the transfer station 39, the second conveyor tape clamp bars 136 and 138 must be raised momentarily in order to avoid retarding the movement of the oncoming edge of the cut segment of sheet material. This is accomplished by closing timer switch TS12 which makes a circuit from common 386 through conduct 420, manual switch 421 to pilot valve V12 to main conductor 372. Immediately thereafter, the conveyor tape clamp bars 136 and 138 must be lowered again. This is accomplished by closing timer switch TS13 which makes a circuit from common 386 through conductor 422, manual switch 424 through pilot valve V11 to main conductor 372.

After the sheet material has left the cutting station 31, the conveyor tape clamp bars 136*a* and 138*a* must be raised out of the way of the gripping member 105 so that the gripping bar can move back from its home position to the entrance position of the cutting station 32. This is accomplished by closing timer switch TS14 which makes a circuit from common 386 through conductor 425 through manual switch 426 through pilot valve V10 to main conductor 372.

When a flaw appears in the sheet material the cut segment in which the flaw appeared is to be marked to identify that segment as having a flaw. The sheet inspection and marking system of the type disclosed in U.S. Pat. No. 4,204,012 is used to make the mark on the segment. In order to detect that the last portion of the segment of sheet material to be cut is moving into the cutting station, timer switch TS16 is closed and makes a circuit to the marking system (not shown).

Figure 18A:
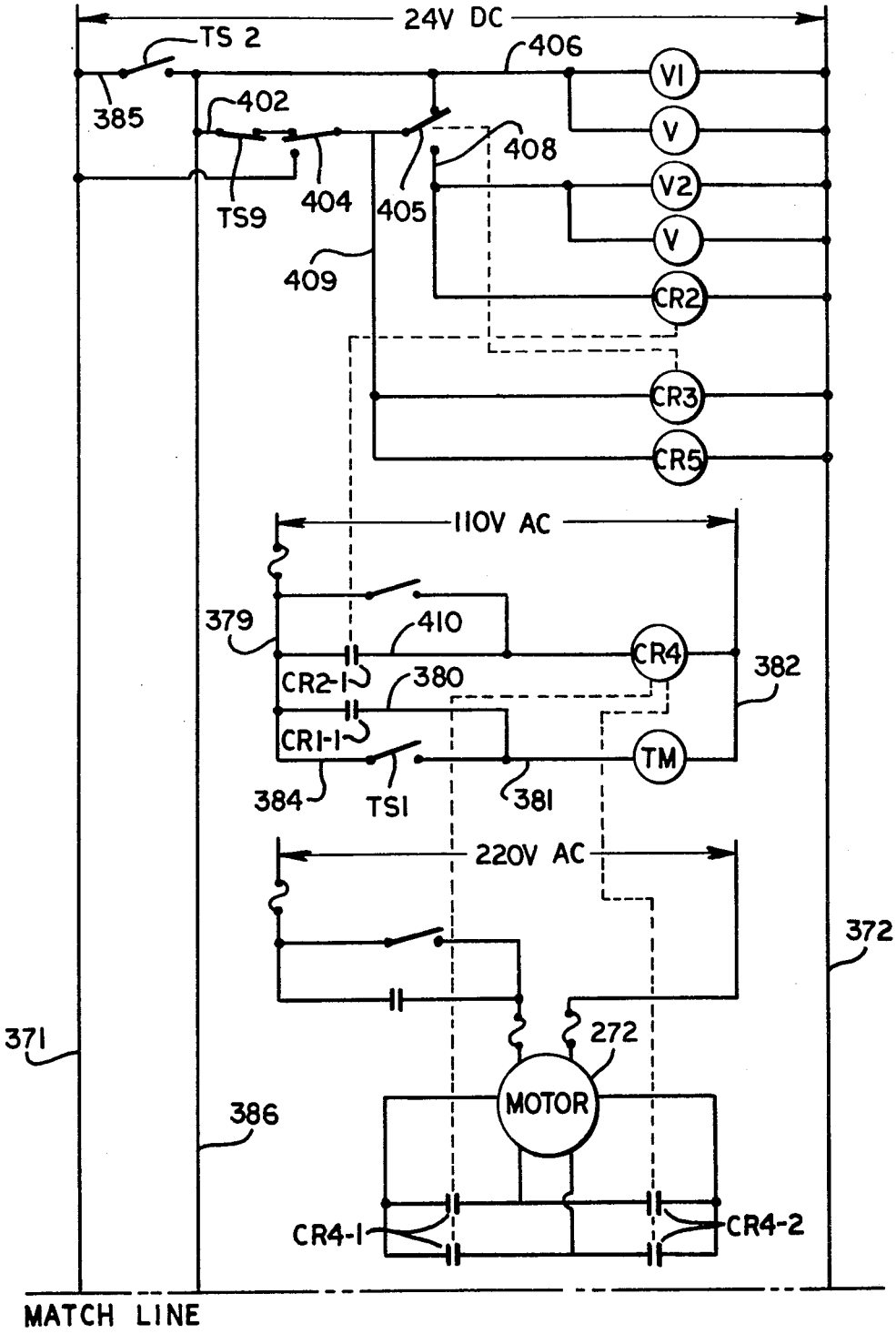
FIGS. 18A and 18B are composite electrical diagrams of the control system for the cutting, expansion and hemming stations.
Figure 18B:
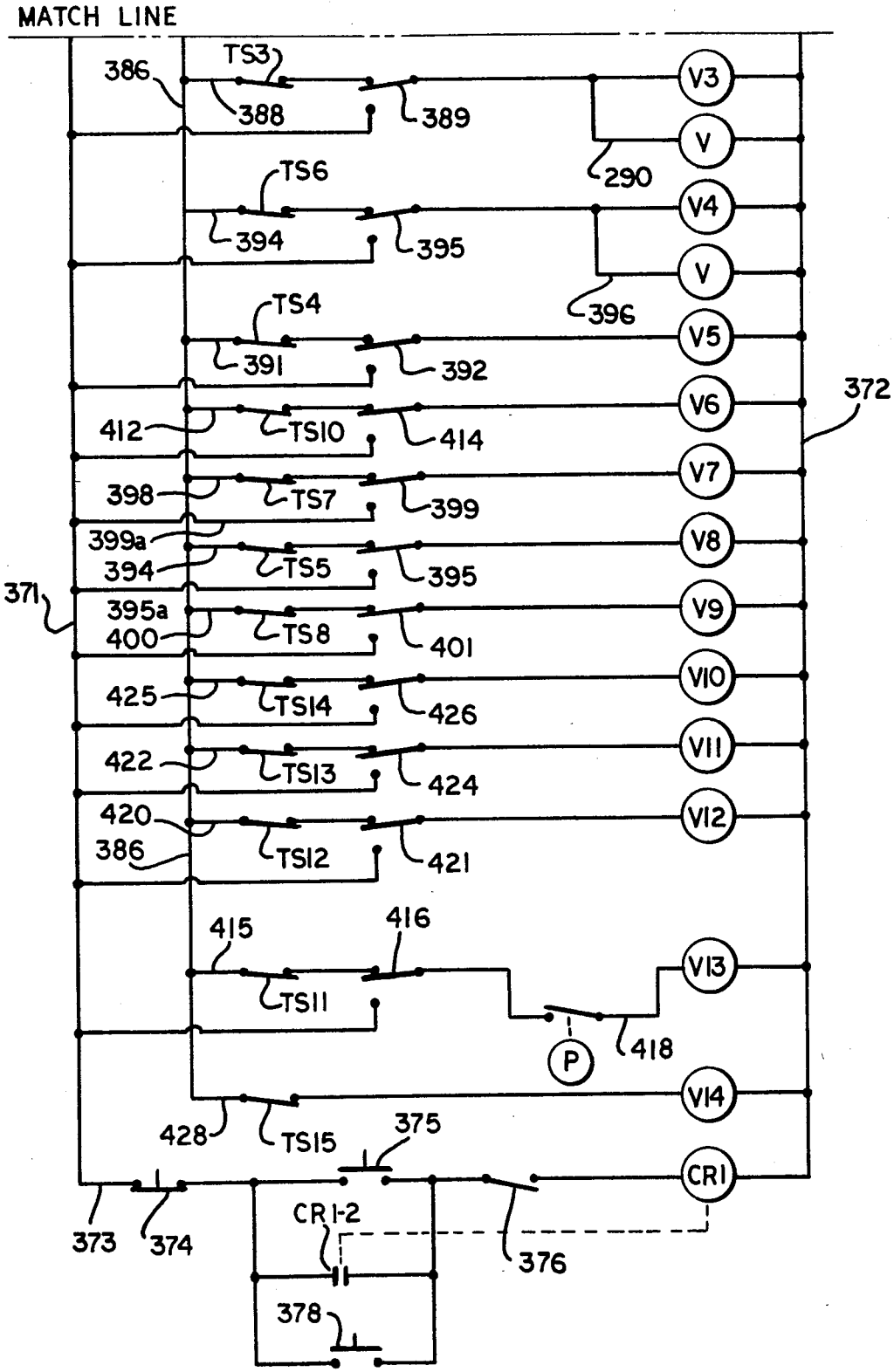

The various manual switches identified throughout the circuit of FIGS. 18A and 18B permit the operator to temporarily close a circuit to the various functional elements of the system. For example, when it is desired to raise or lower the clamp assembly 81, the manual switch 399 or 395 can be moved from its normally closed position with its conductor 398 or 394 to a parallel conductor 399*a* or 395*a* to make a circuit to main conductor 371.

The timing of the movements that are controlled by the circuitry illustrated in FIGS. 18A and 18B are illustrated graphically in FIG. 18.

Figure 19:
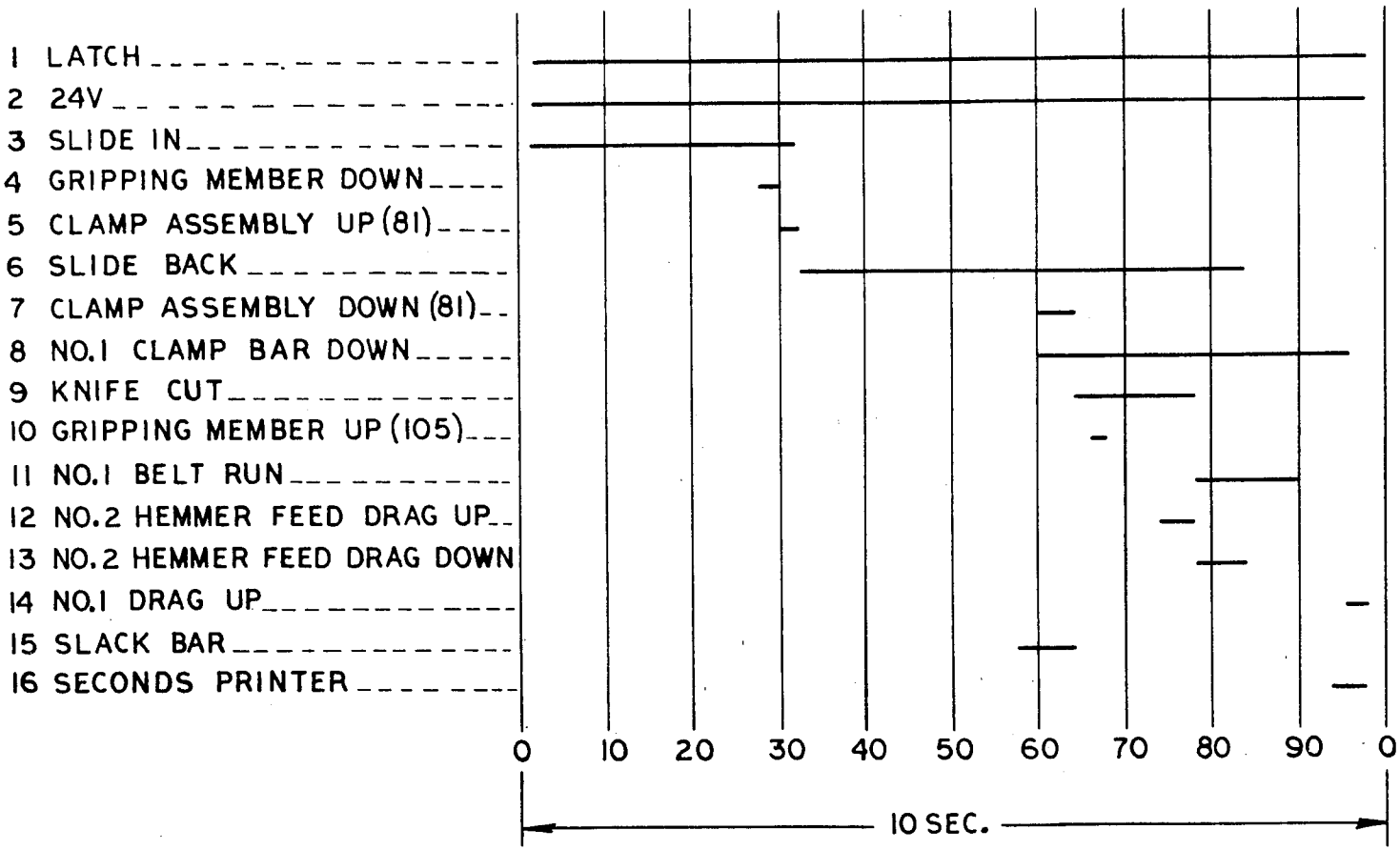
FIG. 19 is a time graph showing the sequence of operation of the switches actuated by the cam system.
Figure 20:
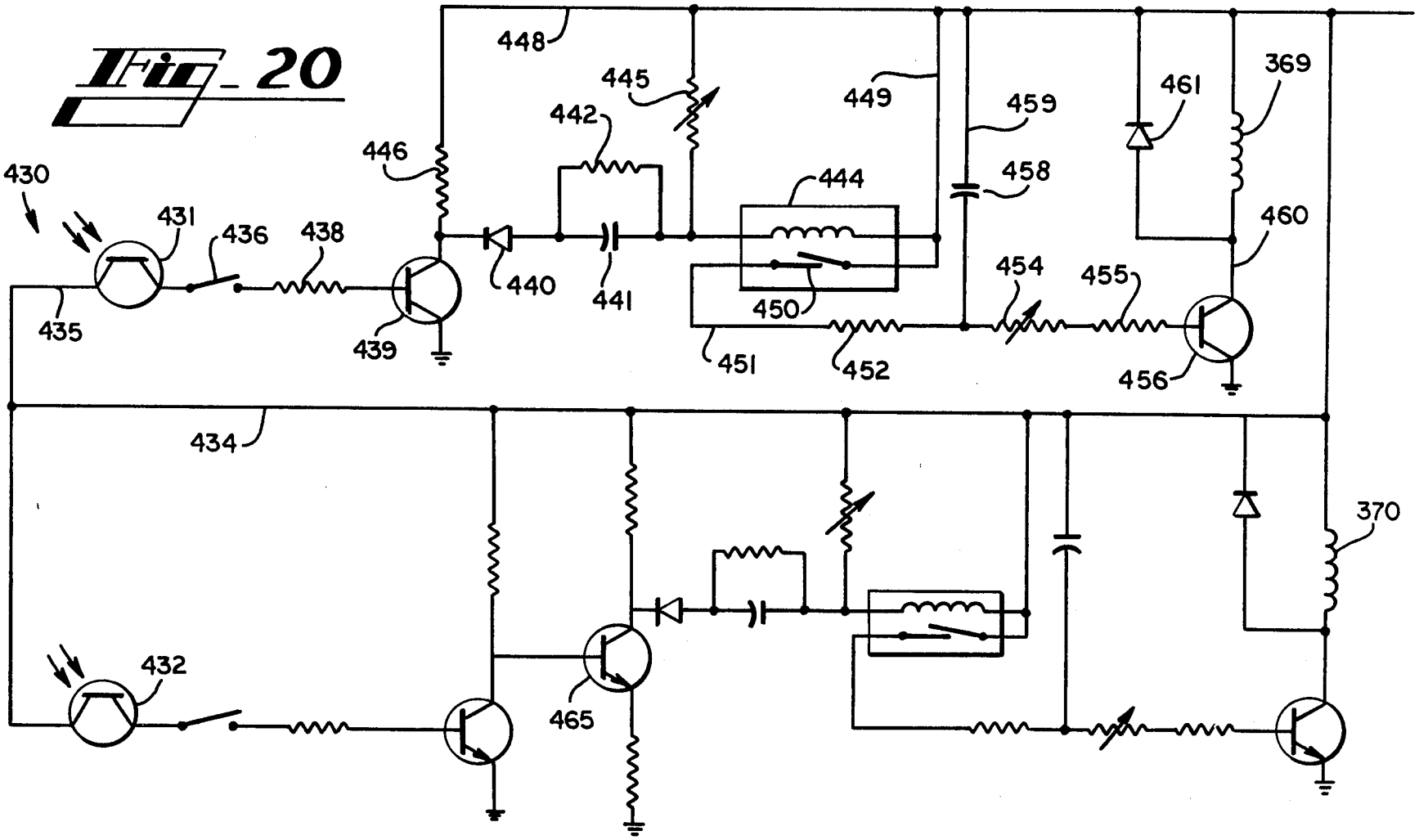
FIG. 20 is an electrical diagram of the control system for the lower transfer belt that adjusts the alignment of the leading and trailing edges of the hem and the main body of the segments of sheet material as the hem moves into the sewing machine.

As illustrated in FIG. 20, the phase shifting of lower transport belt 309 (FIG. 15) is controlled by a circuit 430. Photocells 431 and 432 are positioned in alignment with the path of the segments 34 of sheet material moving through the sewing machines 296. Photocell 431 in the upper portion of the circuitry detects the trailing edge of a segment passing to the sewing machine while photocell 432 in the lower portion of the figure detects the oncoming edge of the segment. The upper and lower portions of the control circuit of FIG. 19 are substantially the same, in that each includes a common line 434, conductor 435 leading from common to the photocell 431 or 432, and on/off switch 436, resistor 438 and transistor 439. Transistor 439 emits a signal in response to a change in the signal from the photocell 431, and the signal is transmitted through diode 440 in parallel to capacitor 441 and resistor 442 to pulse relay 444. The variable resistance 445 is also connected to transistor 439 through resistance 446 and conductor 448. Thus, variable resistor 445 controls the duration of the pulse signal received from capacitor 441 to pulse relay 444.

When relay 444 is pulsed to its closed condition, a signal is received from conductor 449 through the closed switch 450 of relay 444, through conductor 451, resistance 452 and variable resistance 454, resistance 455 to transistor 456. Capacitor 458 is connected in parallel through conductor 459 with respect to transistor 456. When transistor 456 is pulsed, it emits a signal to conductor 460, and in parallel through diode 461 and air motor valve 369 (FIG. 16). Air motor valve 369 permits the passage of air under pressure through a conduit to air motor 365, causing a rotation of the corrector shaft 366, 367 of phase shifter 365. This causes a shift in the phase of the lower transport belt 309, causing a temporary slowdown of the belt. This causes the main body portion 223 of the sheet adjacent the folded over hem 220 to move slower as the trailing edge of the cut segment of sheet material moves through the sewing machine. Therefore, the folded over hem will not be permitted to hang out in its finally sewn together configuration and the selvages of the segment 34 will be aligned.

Photocell 431 which detects the oncoming trailing edge of the segment of sheet material is the type of photocell that detects light, while photocell 432 which detects the oncoming leading edge of the segment of sheet material is the type that detects dark. Thus, an extra transistor 465 is placed in the lower portion of the circuit of FIG. 19 to invert the signal from photocell 432. The remaining portion of the lower circuit is substantially identical to the upper portion. The air motor valve 370 therefore functions to control air motor 365, thus creating an input to the corrector shaft of the phase shifter 364, resulting in a change in speed of the lower transport belt 309 as it carries the lower main body portion of the segment of sheet material on into the sewing machine. It will be noted that there are two variable resistors 445 and 454 in both the upper and lower portions of the circuitry. Variable resistance 454 is used to fine tune the phase shifter while variable resistance 445 is used to multiply the effect of the signal received by air motor valve 369 or 370.

While this invention has been described in detail with particular reference to an embodiment which is specifically constructed to form bed sheets, wherein a hem expander is used to form the large hem at the head of a bed sheet, it will be understood that other sheet products can be fabricated with the disclosed system and hem expanders can be employed on both edges of the sheet material, if desired. Moreover, it will be understood that variations and modifications of the disclosed embodiment can be effected within the spirit and scope of the invention as described hereinbefore and as defined in the appended claims.

I claim:

1. Apparatus for cutting and hemming sheet material comprising means for moving sheet material along its length from a supply toward the entrance of a cutting station, first clamp means at the entrance of the cutting station for holding the sheet material, gripping means movable between the entrance of the cutting station to the other side of the cutting station for gripping the sheet material at the entrance of the cutting station and pulling a segment of sheet material from the supply across the cutting station, a pair of parallel conveyor tapes positioned in said cutting station below the segment of sheet material and normal to the direction of movement of the sheet material into the cutting station, clamp means positioned above the segment of sheet material and movable toward and away from said parallel conveyor tapes for urging the segment of the sheet material in the cutting station against the conveyor tapes, cutting means at the entrance of said cutting station for cutting the segment of the sheet material in the cutting station away from the supply, whereby the segment of sheet material is cut from the supply, and the conveyor tapes move the cut segment of sheet material parallel to its cut edges, and further including means for folding a cut edge portion of the cut segment of the sheet material as the segment is moved parallel to its cut edges, and means for expanding the folded over portion after the edge portion has been folded over.

2. The apparatus of claim 1 and further comprising a rectilinear slack bar movable from a position above the segment of sheet material in the cutting station down into the sheet material.

3. The apparatus of claim 1 and further including means for forming slack in the segment of sheet material in the cutting station.

4. A sheet cutting and hemming system comprising means for moving elongated sheet material from a supply along its length to a cutting station, cutting means at said cutting station for cutting across the sheet material to form a cut segment of sheet material, conveyor means for moving the cut segment of sheet material through a path parallel to the cut edges of the cut segment, folding means positioned along the path of progressively folding a cut edge portion of the cut segment of sheet material into overlying relationship with the body of the cut segment, means for holding the overlying edge portion of the cut segment of sheet material from movement in a direction across the length of the cut edges of the segment, sheet moving means for positively moving the body of the cut segment of sheet material toward the fold in the cut segment of sheet material, and means for directing a flow of fluid in a direction from the sheet moving means toward the fold in the cut segment of sheet material.

5. The invention of claim 4 and wherein said conveyor means comprises a work surface and means for moving the cut segment of sheet material across said work surface, and wherein said folding means comprises a platform spaced above said work surface and means for folding the cut edge portion of the segment of sheet material upwardly onto said platform, and wherein said means for holding the overlying edge portion of the cut segment of sheet material from movement in a direction across the length of the cut edges comprises a conveyor belt movable into engagement with the overlying edge portion of the cut segment on said platform.

6. The invention of claim 4 and wherein said means for positively moving the body of the cut segment of sheet material toward the fold in the segment comprises an elongated roller means positioned beneath said work surface and rotatable about an axis parallel to the fold in the cut segment, clamp means movable from above said work surface down toward engagement with said roller means for clamping the body portion of the cut segment of sheet material into engagement with said roller means, and means for rotating said roller means.

7. In apparatus for hemming sheet material wherein a segment of sheet material is moved on a work surface along a path in a direction parallel to an edge of the sheet material which is to be folded and sewn into a hem, the improvement therein of a fold platform mounted in spaced parallel relationship with respect to said work surface over the path of the segment of sheet material and including an edge portion extending along the path of the segment of sheet material, folding means for folding the edge portion of the segment of sheet material upwardly from beneath the fold platform about the edge portion of said fold platform and onto the top surface of said fold platform in overlying relationship with respect to the body portion of the segment of sheet material, means movable downardly against the edge portion of the segment of sheet material on the top surface of said fold platform for moving the edge portion along the fold platform and for holding the edge portion from movement in a direction across its edge, a movable surface adjacent said fold platform and positioned vertically with respect to the path of the segment of sheet material, clamp means for clamping the body portion of the segment of sheet material against said movable surface, means for moving said movable surface toward the fold in the segment of sheet material, and means for directing a flow of fluid from beneath said fold platform toward the fold in the segment of sheet material to expand the folded portion of the segment of sheet material.

8. The apparatus of claim 7 and wherein said movable surface comprises an elongated roller positioned beneath said fold platforms and the path of the segment of sheet material and rotatable about an axis parallel to the edge portion of said fold platform, and wherein said clamp means comprises at least one clamp member movable from above the path of the segment of sheet material downwardly toward engagement with the upper surface of said roller to bias the body portion of the segment of sheet material against said roller.

9. Apparatus for forming a hem in the edge of a segment of sheet material comprising means for moving the segment along a path with the edge portion to be hemmed extending along the path, a fold platform extending along the path and spaced over the path, means for folding the edge portion upwardly from the path onto the top surface of said fold platform in overlying relationship with respect to the body portion of the segment, upper belt means for engaging and moving the folded over portion of the segment at a position on said platform to a position beyond the end of said platform, and lower belt means for engaging and moving the body portion of the segment from beneath said platform to a position beyond the end of said platform, detecting means for detecting the on-coming edge of the segment, and phase shifting means responsive to said detecting means for shifting the phase of one of said belt means to momentarily change the velocity of said one of said belt means with respect to the other of said belt means.

* * * * *